US009073062B2

(12) United States Patent
Dunn

(10) Patent No.: US 9,073,062 B2
(45) Date of Patent: Jul. 7, 2015

(54) VANE ELECTROSTATIC PRECIPITATOR

(71) Applicant: John P. Dunn, Horseheads, NY (US)

(72) Inventor: John P. Dunn, Horseheads, NY (US)

( * ) Notice: Subject to any disclaimer, the term of this patent is extended or adjusted under 35 U.S.C. 154(b) by 0 days.

(21) Appl. No.: 14/250,467

(22) Filed: Apr. 11, 2014

(65) Prior Publication Data

US 2014/0283686 A1 Sep. 25, 2014

Related U.S. Application Data

(63) Continuation-in-part of application No. 13/369,823, filed on Feb. 9, 2012, and a continuation-in-part of application No. 13/724,286, filed on Dec. 21, 2012, and a continuation-in-part of application No. 13/792,408, filed on Mar. 11, 2013.

(60) Provisional application No. 61/961,778, filed on Oct. 23, 2013, provisional application No. 61/521,897, filed on Aug. 10, 2011.

(51) Int. Cl.

| | |
|---|---|
| ***B03C 3/47*** | (2006.01) |
| ***B03C 3/36*** | (2006.01) |
| ***B03C 3/12*** | (2006.01) |
| ***B03C 3/41*** | (2006.01) |

(52) U.S. Cl.

CPC . *B03C 3/47* (2013.01); *B03C 3/363* (2013.01); *B03C 3/12* (2013.01); *B03C 3/366* (2013.01); *B03C 3/41* (2013.01); *B03C 2201/10* (2013.01)

(58) Field of Classification Search

USPC ..... 95/57, 58, 59, 61, 62, 69, 70, 79–71; 96/15, 17, 54, 55–58, 74, 75–79, 96/95–100, 70, 60, 65, 64, 66, 67, 68, 69

See application file for complete search history.

(56) References Cited

U.S. PATENT DOCUMENTS

| | | | | |
|---|---|---|---|---|
| 1,956,591 A | | 5/1934 | Gies | |
| 2,357,734 A | * | 9/1944 | Jeno | 55/338 |

(Continued)

FOREIGN PATENT DOCUMENTS

| | | | | |
|---|---|---|---|---|
| DE | 545606 | * | 3/1932 | B01F 7/26 |
| EP | 0237512 A1 | | 9/1987 | |
| EP | 1131162 B1 | | 2/2006 | |

OTHER PUBLICATIONS

Turner et al., "Sizing and Costing of Electrostatic precipitators, Part 1", Journal of Waste Manage Association, vol. 38, pp. 458-471, 1988.

*Primary Examiner* — Duane Smith
*Assistant Examiner* — Sonji Turner
(74) *Attorney, Agent, or Firm* — Brown & Michaels, PC

(57) ABSTRACT

Methods using vane electrostatic precipitators collect charged and uncharged particles with vane assemblies that are physically arranged to reduce the air flow rate to at or below 1.0 ft/sec (0.305 m/sec). In preferred embodiments, the main entrained air is divided into smaller proportions by using a plurality of vane assemblies in a vane electrostatic precipitator operating at a specific angle that have discharge electrodes in front of the vanes. This results in both the particles being charged and the flow rate of the air and articles being reduced as they traverse between vanes and over the vane surface. The vane width, operating angle, vane length and vane offset are designed to reduce the air flow rate. As a result, at the ends of the vanes, a high percentage of the air flow is less than 1 ft/s. This allows the particles that are discharged from the vanes during operation to fall by gravity and in the direction of lower air flow, resulting in extremely low re-entrainment and efficient particle collection.

33 Claims, 31 Drawing Sheets

(56) References Cited

U.S. PATENT DOCUMENTS

| | | | | | |
|---|---|---|---|---|---|
| 2,700,429 | A | * | 1/1955 | Wintermute | 96/71 |
| 2,712,858 | A | * | 7/1955 | Wintermute | 96/56 |
| 2,969,127 | A | * | 1/1961 | Cook | 96/58 |
| 3,271,932 | A | | 9/1966 | Newell | |
| 3,338,035 | A | | 8/1967 | Dinkelacker | |
| 3,355,864 | A | * | 12/1967 | Sobeck | 55/443 |
| 3,478,494 | A | | 11/1969 | Lustenader et al. | |
| 3,678,653 | A | * | 7/1972 | Buschman | 96/66 |
| 3,693,328 | A | * | 9/1972 | Paucha | 55/436 |
| 3,733,785 | A | * | 5/1973 | Gallaer | 96/64 |
| 3,757,498 | A | | 9/1973 | Hurlbut, Sr. et al. | |
| 3,807,140 | A | | 4/1974 | Gurvits et al. | |
| 3,958,962 | A | | 5/1976 | Hayashi | |
| 4,007,023 | A | | 2/1977 | Batza | |
| 4,093,432 | A | * | 6/1978 | Ahlrich | 96/78 |
| 4,172,028 | A | | 10/1979 | Dunn | |
| 4,178,156 | A | | 12/1979 | Tashiro et al. | |
| 4,181,509 | A | | 1/1980 | Honacker et al. | |
| 4,231,766 | A | | 11/1980 | Spurgin | |
| 4,246,010 | A | | 1/1981 | Honacker | |
| 4,264,343 | A | | 4/1981 | Natarajan et al. | |
| 4,265,641 | A | | 5/1981 | Natarajan | |
| 4,412,850 | A | | 11/1983 | Kurata et al. | |
| 4,478,614 | A | | 10/1984 | Jonelis | |
| 4,481,017 | A | | 11/1984 | Furlong | |
| 4,666,475 | A | | 5/1987 | Gustavsson | |
| 4,713,092 | A | | 12/1987 | Kikuchi et al. | |
| 4,725,289 | A | | 2/1988 | Quintilian | |
| 4,832,710 | A | | 5/1989 | Jury | |
| 5,156,658 | A | | 10/1992 | Riehl | |
| 5,215,558 | A | | 6/1993 | Moon | |
| 5,466,279 | A | | 11/1995 | Hattori et al. | |
| 5,547,493 | A | | 8/1996 | Krigmont | |
| 5,601,791 | A | | 2/1997 | Plaks et al. | |
| 5,993,521 | A | | 11/1999 | Loreth et al. | |
| 6,004,376 | A | | 12/1999 | Frank | |
| 6,152,988 | A | | 11/2000 | Plaks et al. | |
| 6,482,253 | B1 | | 11/2002 | Dunn | |
| 6,524,369 | B1 | | 2/2003 | Krigmont | |
| 6,773,489 | B2 | | 8/2004 | Dunn | |
| 6,962,620 | B2 | | 11/2005 | Chang et al. | |
| 7,022,166 | B2 | * | 4/2006 | Gittler | 96/64 |
| 7,105,041 | B2 | * | 9/2006 | Dunn | 96/66 |
| 7,582,144 | B2 | | 9/2009 | Krigmont | |
| 7,582,145 | B2 | | 9/2009 | Krigmont | |
| 7,585,352 | B2 | | 9/2009 | Dunn | |
| 7,901,489 | B2 | | 3/2011 | Jin et al. | |
| 2001/0039877 | A1 | | 11/2001 | Hein | |
| 2009/0071328 | A1 | | 3/2009 | Dunn | |
| 2010/0037766 | A1 | | 2/2010 | Boyden et al. | |
| 2010/0037767 | A1 | | 2/2010 | Boyden et al. | |
| 2011/0139009 | A1 | | 6/2011 | Nakahara et al. | |

* cited by examiner

VEP MODEL (I)

VEP MODEL (J)

VEP MODEL - L

VEP MODEL - E

VEP MODEL - H

| | test 170 com 4 Pos (17) | 169 com 4 Pos (17) | 168 com 4 Pos (18) | 171 com 4 Pos (18) | 173 com 4 Pos (2) | 172 com 4 Pos (14) | | 173 com 3 Pos (14) | 172 com 3 Pos (2) | 88 com 3 Pos (17) | 90 COM 3 Pos (18) |
|---|---|---|---|---|---|---|---|---|---|---|---|
| AVG m/s | 1.74 | 2.28 | 0.45 | 1.74 | 0.34 | 6.06 | | 2.64 | 0.32 | 0.24 | 0.59 |
| STDEV | 0.05 | 0.04 | 0.02 | 0.05 | 0.02 | 0.02 | | 0.01 | 0.03 | 0.03 | 0.04 |

| | test 170 com 4 Pos(17) | 169 com 4 Pos(17) | 168 com 4 Pos(18) | 171 com 4 Pos(18) | 173 com 4 Pos (2) | | 172 com 3 Pos (2) | 88 com 3 Pos(17) | 90 COM 3 Pos(18) |
|---|---|---|---|---|---|---|---|---|---|
| % Change | 71.28 | 62.37 | 92.57 | 71.28 | 94.39 | | 88 | 91 | 78 |

VANE ELECTROSTATIC PRECIPITATOR

REFERENCE TO RELATED APPLICATIONS

This application claims one or more inventions which were disclosed in Provisional Application No. 61/961,778, filed Oct. 23, 2013, entitled "VANE ELECTROSTATIC PRECIPITATOR".

This application is also a continuation-in-part of:

Co-pending application Ser. No. 13/369,823, filed Feb. 9, 2012, entitled "VANE ELECTROSTATIC PRECIPITATOR", which claims one or more inventions which were disclosed in Provisional Application No. 61/521,897, filed Aug. 10, 2011, entitled "VANE ELECTROSTATIC PRECIPITATOR (VEP)".

Co-pending application Ser. No. 13/724,286, filed Dec. 21, 2012, entitled "VANE ELECTROSTATIC PRECIPITATOR".

Co-pending application Ser. No. 13/792,408, filed Mar. 11, 2013, entitled "VANE ELECTROSTATIC PRECIPITATOR".

The benefit under 35 USC §119(e) of the United States provisional applications is hereby claimed, and the aforementioned applications are hereby incorporated herein by reference.

BACKGROUND OF THE INVENTION

1. Field of the Invention

The invention pertains to the field of electrostatic precipitators. More particularly, the invention pertains to vane electrostatic precipitators.

2. Description of Related Art

U.S. Pat. No. 4,172,028 discloses an electrostatic sieve having parallel sieve electrodes that are either vertical or inclined. The particles are normally introduced into the electric sieve under the control of a feeder that is placed directly in front of the opposing screen electrode. The powder is attracted directly from the feeder tray to the opposing screen electrode by an induced electric field that exists between the tray and the screen electrode. This system is a static air system.

U.S. Pat. No. 4,725,289 uses flow dividers in an electrostatic precipitator to try to control flow. Discharge of collected dust particles is still taking place where the air flow is relatively high, making re-entrainment a strong possibility.

Prior art precipitators have difficulty collecting highly conductive and very poorly conductive particulates.

There is also a need to improve on present electrostatic precipitator technology used to continuously collect coarse and fine coal ash particles from coal fired boilers related to the fact that bag houses are now used in conjunction with electrostatic precipitators to better clean the air.

SUMMARY OF THE INVENTION

In one embodiment, a method for processing large volumes of entrained air and efficiently collecting particulates uses multiple vane electrodes that subdivide the main air stream into smaller individual air streams for more efficient processing rather than parallel plate electrodes found in standard electrostatic precipitators. This is preferably achieved by arranging the vane assembly so that they operate 3 to 80 degrees from the main air flow and the individual vanes operate at 45 to 95 degrees from the main air flow.

In another embodiment, a method for collecting the more difficult high resistant and conductive particles uses contour vanes in an assembly that offers greater resistance to air flow, or when restriction of space warrants the use of contour vanes or when the size of the vane warrants a structurally stronger construction. In some preferred embodiments, a 12 inch wide contour vane with less than a 13 degree minor arc or bow reduces the vane width by almost one sixth its original length.

Another embodiment discloses a precipitator that can efficiently collect particulates moving above the normal input flow rates of 5 to 6 ft/sec. In preferred embodiments, the rates exceed 15.0 ft/sec. In some embodiments, vane assemblies operate with a much steeper angle (for example, 68 degrees), and a vane operating angle is set at 9 degrees from main air flow or from the center line of the equipment. This design efficiently collects particulates using flow rates as high as 20 ft per second. Using the more shallow angle changes the profile of the VEP so that it has a narrower and longer profile resulting in the main air flow rate slowing down as it proceeds through the VEP.

In another embodiment, a method for achieving lateral airflow uses a combination of both particles passing through an intense and concentrated electric field that has been established between the discharge and the leading edge of the vane electrode where the flux lines will direct the charged particle to move laterally towards the vane and by subdividing the main air flow so that the particles are diverted and deflected by how the vane assembly operating angle and vane offset are set. The greater the offset, the larger amount of CFM is processed by the vane pair.

In yet another embodiment, a method for collecting charged and uncharged particles uses vane assemblies that are physically arranged to reduce the air flow rate to at or below 1.0 ft/sec (0.305 m/sec) by determining the number of vanes, the desired offset of the vanes, the overall size of the vanes, the distance between vanes, the operating angle of the vanes within the assembly, the vane assembly operating angle and the number of columns of vane assemblies (called fields). These fields or vane assemblies may be arranged either as a single or dual mirror image unit. All of these factors are based on the type of material being collected, the particle concentration per ACFM requirements, and operating conditions such as air velocity, temperature, humidity, etc. In preferred embodiments, the flow direction of the entering entrained air is changed by using a plurality of vane electrodes that subdivide the main air flow so that smaller portions of the entrained air has to be charged and collected. The diverted air is directed to flow between vanes that induce a drag on the entrained air, lowering the air flow rate to the desired rate of below 1 ft/sec, (0.305 m/s). The particles that are discharged from the vane surface flow away from the main air flow into an area behind the vanes where the air flow rate is substantially reduced.

In other embodiments, a method collects the more difficult highly resistant and conductive materials. Charged and uncharged particles that flow into and between two vanes that are at ground potential are either attracted to the vane surface or continue to flow both in the direction of lower air flow and fall by gravity towards the collection container. Charged conductive particles that are attracted to the vane surfaces immediately give up their charge and continue to flow both in the direction of lower air flow and fall by gravity towards the collection container.

In another embodiment, a method of collecting entrained air particles includes two separate columns of vane assemblies, each with a mirror image component through the center line of the VEP. The first column of vanes directs the air to flow towards the outer wall while the second column directs the air to flow towards the centerline of the VEP. In some of these embodiments, the input and output orifices are not the same size as each other. In some other embodiments, the input and output orifices are relatively large and equal in size. In some of these embodiments, the input and output orifices are each at least approximately 5 to 10 feet in width.

In another embodiment, a method collects a plurality of particles from an entrained air stream that travels through a precipitator, where 95 to 100 percent of the entrained air passes between and through vane assemblies before flowing through the next column of vane assemblies or exiting the precipitator.

In yet another embodiment, a method controls the air flow rate in a vane electrostatic precipitator so that particles can be collected and not re-entrained back into the main air stream based on the CFM, properties of the particulates and gas, process and structural requirements. These include vane width and length (and surface area), type of vane (e.g.—straight or contour), the total number of vanes in the vane electrostatic precipitator, the number of vanes in a vane assembly, the number of vane assembles in the vane electrostatic precipitator, the vane assembly design (similar or counter flow), the vane operating angle, the vane assembly operating angle, the offset between vanes, the distance between vanes, the number of fields, the material the vanes is made out of, the number of discharge electrodes per vane assembly, the distance between a discharge electrode and a leading edge of the vane, the distance between discharge electrodes, and the size and types of discharge electrodes.

DETAILED DESCRIPTION OF THE INVENTION

Figure 1:
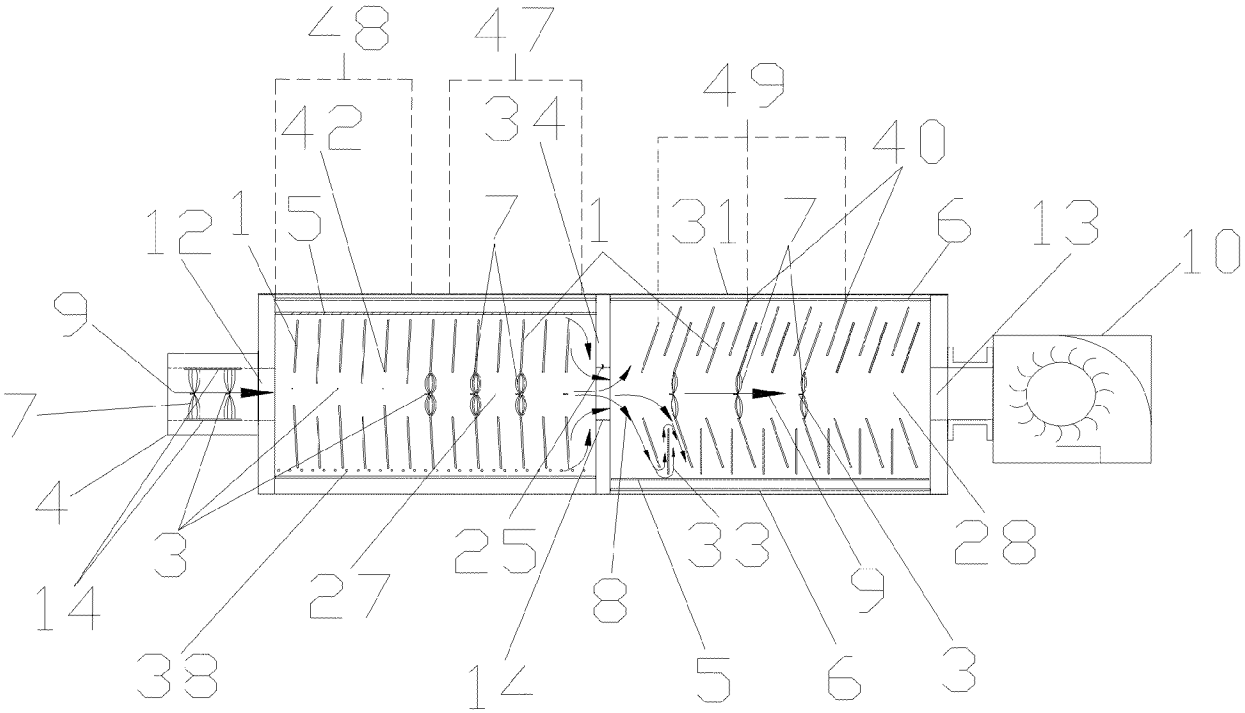
FIG. 1 shows a cross sectional view of a horizontal airflow dual chamber vane electrostatic precipitator showing several vane configurations that can be used in an embodiment of the present invention.

The terms "vane", "vane electrode", "vane type electrode" and "vane type collecting electrode" are used interchangeably herein. A vane assembly, as described herein, is a group of vanes that are structurally assembled as one unit. The terms "input and output orifice" and "input and output aperture" are also used interchangeably herein.

The vane electrostatic precipitator technology described herein improves on the development of a "Grid Electrostatic Precipitator" (GEP). Patents related to the GEP technology include U.S. Pat. Nos. 6,773,489, 7,105,041 and 7,585,352, the disclosures of which are herein incorporated by reference.

Some applications for the VEP technology include, but are not limited to, collecting fly-ash and other particles from coal fired burners (both small and large coal fired furnaces), collecting hazardous waste, collecting glass and ceramic dust particles, collecting smelter dust particles, cement manufacturing (and other processing areas for industrial dust and vapors), cyclone dust collectors, and collecting and returning solid particles to a process.

Several new factors have been identified as having a major bearing on the collection efficiency of a vane electrostatic precipitator. These include the vane offset, the width of the orifices (with wider orifices, the air flow capacity increases and, in some applications, the length of the field is reduced), the vane assembly angle, the number of discharge electrodes in relation to the number of vane electrodes, and the position of discharge electrodes in relation to the leading edges of the vane electrodes.

The need to improve on methods used to continuously collect coarse and fine aerosol and industrially generated particles using the existing electrostatic precipitators (ESP) is an ongoing effort especially in the collection of coal fired ash. The vane electrostatic precipitators (VEP) described herein improve the process of collection of fine (<2.5 microns) and coarse particles as well as substantially reducing or eliminating re-entrainment and reducing the overall size of the precipitator.

A vane electrostatic precipitator (VEP) controls the air flow so that the entrained air particles are continuously subjected to a stress in the form of drag as they flow in front of and behind vanes electrodes in the precipitator. Collection is not based on achieving laminar air flow over the collecting plates. Instead, efficient collection is achieved by operating with vane electrodes in various configurations with porous back plates that gradually reduce the flow rate of the entrained air, thereby allowing the particles to precipitate and collect on the vanes. Entrained air flows over the face and back side of vanes that not only collect the particulates but continuously induce resistance to the flow of entrained air and conversely increases the chance for particle collection.

The embodiments described herein improve on the present electrostatic precipitator method of using parallel plates to collect particulates by using multiple parallel vanes set at the operating parameters described below. By using vanes, the main entrained air is subdivided and directed to flow between vanes that induce resistance to flow, allowing charged particles to collect on the vanes. The vane is designed to be wide enough so the air flow rate at the ends of the vanes is less than one foot per second (<1 ft/s), allowing particles discharged from the plates to fall by gravity and in the direction of very low air flow, resulting in extremely low re-entrainment and efficient particle collection. Using vanes also allows for higher operating air velocities resulting in a smaller equipment foot print.

In one embodiment, a method for removing particles from at least one main air stream uses a vane electrostatic precipitator including opposing vane type collecting electrodes. A leading edge of each vane type collecting electrode is offset from an adjacent leading edge such that each vane type collecting electrode is either longer or shorter than a preceding vane type collecting electrode to improve control and efficiency of collection of the particles. The method includes dividing the main air stream into at least two smaller individual air streams in the vane electrostatic precipitator. The smaller individual air streams refer to the air that flows between the vanes. The method also preferably includes a step of dimensioning an input orifice and/or an output orifice and the vane type collecting electrodes to match operational requirements of the main air stream.

The vane electrostatic precipitator in some preferred embodiments may further include saw tooth discharge electrodes located on an angle matching an angle of the leading edges of the vane type collecting electrodes or parallel to the main air stream. The vane type collecting electrodes are preferably located at ground potential, resulting in no electrical field being established between opposing vane type collecting electrode surfaces, and an electrical field is established between the leading edge of the vane type collecting electrodes and the discharge electrodes.

The method may preferably also include a step of dividing the vane type collecting electrodes into a plurality of operating groups, each including at least two vane electrodes. The operating groups are preferably combined into a vane assembly to match operating requirements for the vane electrostatic precipitator.

In another embodiment, a vane electrostatic precipitator includes vane electrodes having a leading edge and located at ground potential and discharge electrodes located at an angle matching the main air flow direction and in proximity to a leading edge of the vane electrodes, such that an electrical field is established between the leading edge of the vanes and the discharge electrodes and no electrical field exists between opposing surfaces of the vanes. A method collects particulates using this vane electrostatic precipitator using an electrical field established between the leading edge of the vane electrodes and the saw tooth discharge electrodes. The method also preferably includes a step of dimensioning an input orifice and/or an output orifice and the vane type collecting electrodes to match operational requirements of an air stream.

In another embodiment, the main air stream is divided into a number of smaller individual streams in a vane electrostatic precipitator. The vane electrostatic precipitator includes opposing vane type collecting electrodes that are tapered as an assembly from front to back and towards the center of the main air flow of the collection chamber to improve control and efficiency of collection of the particles.

In some embodiments, placing the leading edges of the vanes directly opposite the discharge electrodes, and/or the distance between the discharge electrode and the leading edge of the vane electrode being shorter than the distance between the discharge electrodes improves the collection process.

In one preferred embodiment, a method for removing particles from at least one main air stream uses a vane electrostatic precipitator to collect the particulates using an electrical field established between a leading edge of a plurality of vane electrodes and a plurality of discharge electrodes. The discharge electrodes are located in proximity to the leading edge of the vane electrodes, and a distance between the leading edge of the vane electrodes and the discharge electrode is less than a distance between adjacent discharge electrodes. In preferred embodiments, a ratio between a number of discharge electrodes and a number of vane electrodes in a vane assembly is less than 3:1, more preferably 2:1 and most preferably, approximately 1:1.

In a preferred embodiment, a method for removing particles from at least one main air stream using a vane electrostatic precipitator includes the step of collecting the particulates using an electrical field established between a leading edge of a plurality of vane electrodes and a plurality of discharge electrodes. The vane electrostatic precipitator includes the plurality of vane electrodes and the plurality of discharge electrodes in proximity to the leading edge of the vane electrodes, and a ratio between a number of discharge electrodes and a number of vane electrodes in a vane assembly is less than 3:1. In a further preferred embodiment, the ratio between the number of discharge electrodes and the number of vane electrodes in a vane assembly is approximately 1:1.

For the efficient collection of particulates by electrostatic precipitators generated by wood or coal burning furnaces, the desired flow rate at the collecting surface should be less than 1 ft/s. Collected particles leaving the vane or plate surface should also have a desired air flow rate below 1 ft/s. Vane electrostatic precipitators described herein are designed to control air flow rate so that the above requirements can be achieved. It also addresses the need to reduce the overall size or equipment cost and the need to process high volumes of entrained air.

While some of the embodiments include the idea of using narrow, equal size input and exit apertures, in other embodiments, either equal or unequal size apertures (which do not need to be narrow) can be used when required. In preferred embodiments, 95 to 100 percent of the entrained air is passed between and through vane assemblies before flowing through the next column of vane assemblies or exiting the precipitator.

Figure 18:
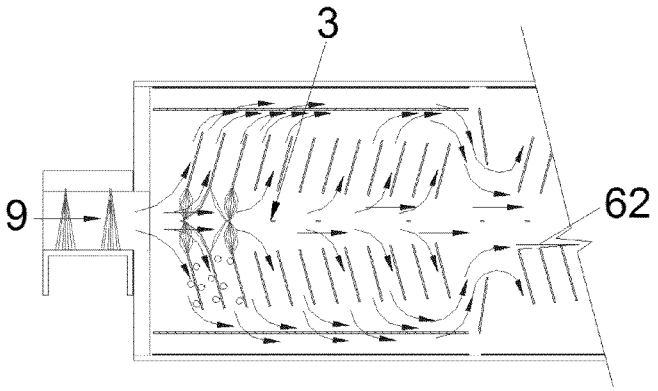
FIG. 18 shows a cross-sectional view of a vane electrostatic precipitator showing a vane, a baffle configuration, and an air flow pattern.

The GEP and the some of the VEP embodiments described herein achieve collection by depending on having a narrow air stream and with parallel grid or vane electrodes and centrally located discharged electrodes. Particle collection was achieved by establishing an electrical field being between the discharge electrodes and the grid wires or the vane leading edges. Particles that became charged moved laterally out of the main higher flowing air stream to a lower air flow area by following the flux lines established between the discharge electrode and the grid wire or the leading edge of the vane electrode, as shown in FIG. 18. One example of a vane operating angle 62 in FIG. 18 is 3°.

Some embodiments of the VEP achieve their high collection rate by using a plurality of single or multiple vane assemblies that operate at specific angles and are offset from each other so that the main air flow is subdivided into the desired proportions as opposed to using the parallel plate concept, where the spacing between the plates in an ESP is generally wider in order to achieve the lower air flow rate at the surface of the plate. Use of vanes results in a shorter overall length of the VEP and improved efficiency of collection.

The vane operating angle is adjusted to meet the process requirements and is, in some embodiments, preferably varied from approximately a 45 to 95 degree angle from the main air flow. The operating angle plus the length of the vanes determine the amount of drag induced on the particles so that they are either attracted to the vane surface or fall by gravity. The process has been successful in collecting nonconductive, conductive as well as high resistivity particles.

In some embodiments of the vane electrostatic precipitator, the discharge electrodes are centrally located between vanes. There is an electrical field between discharge electrodes and the leading edge of the vane, but no field between opposing vane surfaces. In other embodiments, the leading edges of the vane electrodes are offset from each other, which helps the particles move out of the main airflow, and also subdivides the air flow. In some of these embodiments, the offset is less than or equal to 0.025 inches. In other embodiments, the distance between leading edge of vane electrodes and the discharge electrodes (preferably saw tooth discharge electrodes) are between approximately 0.75 and 2 inches. Other embodiments include tapered vane electrodes from the front to the back of the vane electrostatic precipitator. In still other embodiments, the ends of the discharge electrodes face the leading edge of the vane electrodes. In other embodiments, the distance between the leading edge of the vanes and the discharge electrodes is less than the distance between the discharge electrodes. In some embodiments, the ratio between discharge electrodes and vane electrodes <3:1. In some other embodiments, there are two sets of vanes, where the second set of vanes are mirror images of the first set of vanes, which creates a counter/reverse flow. Any combinations of these embodiments, or any of the other embodiments described herein, could be used in the precipitator.

In one embodiment, a method for processing large volumes of entrained air and efficiently collecting particulates uses multiple vane electrodes rather than parallel plate electrodes found in standard electrostatic precipitators. This is achieved by arranging the vane assembly so that they operate 3 to 80 degrees from the main air flow and the individual vanes operate at 45 to 95 degrees from the main air flow.

In another embodiment, a method for collecting the more difficult high resistant and conductive particles uses contour vanes in an assembly that offers greater resistance to air flow or when restriction of space warrants the use of the more expensive contour vanes or when the size of the vane warrants a more rigid, stronger construction. In one example, a 12 inch wide contour vane with less than a 13 degree minor arc or bow reduced the vane width by almost one sixth its original length.

Another embodiment discloses a precipitator that can efficiently collect particulates moving above the normal input flow rates of 5 to 6 ft/sec. In preferred embodiments, the rates exceed 15.0 ft/sec. In some embodiments, vane assemblies operate with a much steeper angle (for example, 68 degrees), and a vane operating angle is set at 81 degrees from main air flow or from the center line of the equipment. This design efficiently collects particulates using flow rates as high as 20 ft per second. Using the more shallow angle changes the profile of the VEP so that it has a narrower and longer profile, resulting in the main air flow rate slowing down as it proceeds through the VEP.

In another embodiment, a method for achieving lateral airflow uses a combination of both particles passing through an electric field that has been established between the discharge and the leading edge of the vane electrode where the flux lines will direct the charge particle to move laterally towards the vane and by subdividing the main air flow so that the particles are diverted and deflected by how the vane assembly operating angle and vane offset are set. The greater the offset, the larger amount of CFM is processed by the vane pair.

In yet another embodiment, a method for collecting charged and uncharged particles uses vane assemblies that are physically arranged to reduce the air flow rate at or below 1.0 ft/sec (0.305 msec) by determining the number of vanes, the desired offset of the vanes, the overall size of the vanes, the distance between vanes, the operating angle of the vanes within the assembly, the vane assembly operating angle and the number of columns of vane assemblies (called fields). These fields or vane assemblies may be arranged either as a single or dual mirror image unit. All of these factors are based on the type of material being collected, the particle concentration per ACFM requirements, and operating conditions such as air velocity, temperature, humidity, etc. In preferred embodiments, the flow direction of the entering entrained air is changed by using a plurality of vane electrodes that subdivide the main air flow so that smaller portions of the entrained air has to be charged and collected. The diverted air is directed to flow between vanes that induce a drag on the entrained air, lowering the air flow rate to the desired rate of below 1 ft/sec, (0.305 m/s). The particles that are discharged from the vane surface flow away from the main air flow into an area behind the vanes, where the air flow rate is substantially reduced.

In other embodiments, a method collects the more difficult high resistant and conductive materials. Charged and unchangeable particles that flow into and between two vanes that are at ground potential are either attracted to the vane surface or continue to flow both in the direction of lower air flow and fall by gravity towards the collection container. Charged conductive particles are attracted to the vane surfaces but immediately give up there charge and continue to flow both in the direction of lower air flow and fall by gravity towards the collection container.

In most embodiments, the input and output aperture size is dependent on the CFM and input parameters. In the embodiments described herein, the apertures can be designed to accommodate the full range of air flow found in industry (200 to over 1,000,000 CFM).

In earlier developed vane embodiments where the vane assemblies were arranged parallel to the main air flow, the preferred input and output apertures were the same size. In new embodiments described herein, the vane assemblies operate at a specific angle to meet various operating conditions. In some embodiments, the input and output orifices are the same size, and are each at least approximately 5 to 10 feet in width. In other embodiments, the input orifice is larger than the output orifice.

The coal industry is one example of where a wide range of aperture sizes are used. The CFM requirements vary from several hundred CFM for coal burning stoves to utility coal burning boiler furnaces where millions of CFM may be required.

Unlike standard ESPs with plate electrodes, in the VEPs disclosed herein, there is a high intensity field between the vane electrodes and the discharge electrodes. Most of the field is at the tip of the vane electrode. Particles pick up a charge when they pass through the electric field, and the particles get pulled out of the airflow (and into the vanes). In this manner, the air flow is "subdivided". Each vane gets part of the air flow as it pulls down the particles. In some preferred embodiments, an offset between the vanes is used. The greater the offset, the more efficiently the particles get pulled down into the vane and out of the main airflow.

In some applications, more current may be required to charge some particles than others.

In some embodiments, the distance between the discharge electrodes and the vane electrodes is less than the distance between the discharge electrodes. These distances depend on what types of materials are being collected in the precipitator. In some preferred embodiments, the distance between the discharge electrodes and the vane electrode is between approximately ¾" and 2". In another preferred embodiment, this distance is between approximately ¾" and 1". In an alternative preferred embodiment, this distance is between approximately 1" and 2". In one preferred embodiment, the distance between the discharge electrodes and the vane electrodes is approximately ¾" and the distance between the discharge electrodes is approximately 1".

In some preferred embodiments, the distance between vanes is increased to collect more particles. As one example, when collecting fly ash, a distance of 1½ to 2 inches between vanes is preferred because particle concentration per cubic foot is high. Alternative ways to effectively process the fly ash would be to increase the length of the vanes, or contouring the shape of the vanes. In other embodiments, the distance between vanes is preferably uniform.

In some embodiments, the vane electrodes are on an angle deviating from 90 degrees. In some embodiments, the vanes are at an angle between approximately 45-95 degrees.

The vane electrostatic precipitator uses either wire or the preferred band saw blade type. The band saw blade can be modified by varying the number of teeth per inch or by using either straight or offset teeth along the length.

The vane electrostatic precipitators disclosed herein remove and continuously collect coarse, fine, and sub micron particles from an air stream by inducing entrained air to follow a tortuous flow path that slows the rate of flow of both the gas and the particles. The vane electrostatic precipitators are designed to induce a lateral flow that allows the particles to be collected on the vanes and other collecting devices so that when the particles are removed by impact, they fall into the dust collecting chamber without returning to the main air stream. The vane electrostatic precipitators create turbulence in the air flow to improve collection efficiency. The vane electrostatic precipitators use a single or multiple air streams or channels that initially draw entrained air past external pre-chargers and then into the vane electrostatic precipitator collection chamber.

There is an electric field between the edges of the vanes and the central discharge electrodes. The vanes are preferably located at ground potential, so that there is no electrical field between opposing surfaces, substantially reducing the problems associated with back corona. Even if the vanes collect particles during the precipitation process, the collection is primarily on the sides of the vane, and does not interfere with the electric field that is between the leading edge of the vanes and the discharge electrodes. In some embodiments, the edges of the vanes may be polished to repel particles from collecting on the ends to further reduce back corona.

The design of the pre-charger in these devices is flexible; it can be designed to provide the initial charging of particles or to achieve some aggregation or agglomeration of fine and submicron particles before they enter the vane electrostatic precipitator collection chamber. Particles entering the collection chamber continue to be charged by the discharge electrodes that are centrally located and distributed along the length of the collection chamber. Some examples of pre-chargers can be found in US Patent Publication No. 2009/0071328, published Mar. 19, 2009, entitled "GRID TYPE ELECTROSTATIC SEPARATOR/COLLECTOR AND METHOD OF USING SAME" and herein incorporated by reference. Other pre-chargers disclosed herein or known in the art could alternatively be used.

The vane electrostatic precipitators improve the process for collecting particles by taking advantage of the normal airflow pattern that occurs when air passes through the aperture and into the chamber. Some of the entrained air flows straight, while some expands and flows laterally over the vane electrodes as the air enters the precipitator. The vane electrodes that oppose each other are normally at some angle or near perpendicular to the air flow in order to compensate for process application and variables.

Particles that traverse over the vanes are either collected or continue on to be collected by the porous, preferably mesh-like, material or pass through the porous structure and flow back into the main air stream. The air that has passed over the vanes and through the porous material sees a gradual reduction in particle concentration and a lower velocity resulting in improved collection per unit length of precipitator.

A series of parallel vanes gradually removes a portion of the entrained air so that it circulates over the front and back of the vanes and the porous (in some preferred embodiments, mesh) material that is normally located in back of the vanes, resulting in constant re-charging of particles and gradual reduction in air velocity. In some embodiments, the vanes may be hanging from the electrostatic precipitator housing.

The type of vane, the number of vanes per linear foot, the distance between vanes, and the position or angle along the length of the vane electrostatic precipitator are designed to slow and collect particulates as well as to circulate all of the entrained air that enters to be collected. In one preferred embodiment, the distance between the vanes is between approximately ⅜" and ½". In another preferred embodiment, a distance between the vanes is larger at the input aperture and smaller at the exit aperture. In yet another preferred embodiment, a distance between the vanes is uniform throughout the precipitator. The overall dimensions, length, width, and thickness of the vanes depend on the application and operational requirements such as volumetric air flow rate (CFM), particle size, and concentration. Air flow measurements between some of the vane designs have been six times lower (0.3 msec) than the main air flow (2.4 m/sec). Behind the vanes and next to the porous membrane, the air flow measured 3 times lower (0.8 msec) than the main air stream (2.4 m/sec). These numbers are used to illustrate the potential of the vane electrostatic precipitators to efficiently collect particulates.

Increasing the number of parallel and opposed vanes increases the surface area per linear foot, and exposes particles, as well as increasing the number of electrical flux lines. The type of material and configuration of holes in the porous membrane/material vary based on the properties of the material being collected.

Having the collecting electrodes (vanes) near 90 degrees from the main air stream, as opposed to flat plate technology, results in the ability to collect conductive particles; these would not normally attach to the collecting plate but would be re-entrained into the main air stream. With the vane electrostatic precipitators described herein, the conductive particles lose their charge by contact and continue to flow further into the vane, where the air movement has been substantially reduced, and therefore fall by gravity into the collection chamber below without being re-entrained.

The Deutsch-Anderson equation, $n=1-\exp(-AW/V)$, is useful for determining particulate collection efficiency in electrostatic precipitators, including grid and vane electrostatic precipitators. In this equation, n is the collection efficiency decimal fraction; A is the collection area in square feet of an electrostatic precipitator (ESP); V is the flow rate of the gas as it enters the ESP in cubic feet per second and W is the migration velocity of a particle under the influence of electrical field in feet per second.

The previous equation is over simplified but it is a key to developing the vane electrostatic precipitator. It refers to the migration of charged particles to a collecting surface of vanes, plates, grids, porous type material, etc. The time it takes for charged particles to migrate to the collecting surface determines the overall size of the precipitator and is affected by field strength, gas viscosity, and the distance it has to travel to a collecting surface.

A narrow airflow pattern used in some of the vane electrostatic precipitators can be achieved by using input and exit end apertures that closely match both the size and distance between the parallel and opposing vanes.

The use of a conventional flow pattern and spacing between the discharge and plate electrodes would not work with the narrow spacing, because when the collected material is removed from the plates, most of the material would be entrained back into the main air stream.

The trend in the industry has been to increase the distance between the discharge and collection electrodes. These changes are related to design changes to increase the physical strength for both the collecting plate and discharge electrodes. In contrast, the devices and methods disclosed herein preferably reduce this distance.

With the vane electrostatic precipitator, the electrical field and the flux lines are established between the edge of the opposing vanes and the discharge electrode, allowing charged particles to move laterally out of the main air stream and flow over vane electrodes to be collected.

With the vane electrostatic precipitator, the charged particles follow the flat or contour vane electrodes into other vanes or devices that slow the airflow and collect the particles. Particles that are collected are discharged by impact and fall by gravity into a dust collection container.

Factors to be considered when designing a vane include, but are not limited to, the contour or arc of the vane, whether the vane is fixed or can rotate, the length and width of the vane, and the type of surface used on the vanes. Some textures or surfaces that can be used on the vanes include, but are not limited to, polished, oxidized, or coated surfaces including, but not limited to, chrome plated or polytetrafluoroethylene (PTFE, e.g.—Teflon® surfaces) coated surfaces. Some ways to vary the texture of the vanes include, but are not limited to, grit blasting using various materials that have varying degrees of hardness. These factors vary and will depend on what is being collected, air velocity, and the difficulty in removing material collected on the vanes.

These factors and others influence the amount of drag induced on both the air and particles, resulting in improving the collection of charged particles. Based on how the vanes are positioned in relation to the main air flow, the collected particles that are discharged from either the vane or the collection device located after the vane either fall by gravity into the dust collection chamber or choose to circle back over the backside of the vanes towards the main air stream to be reprocessed by the next group of vanes.

In the preferred embodiments, the precipitator includes both conductive and non-conductive vanes. In one preferred embodiment, the conductive vanes are made of steel or other conductive materials. In other preferred embodiments, the nonconductive vanes are made of fiberglass or polyester. In embodiments where one or more of the vanes is closer to the back plate than the other vanes, the closer vane is preferably made of a nonconductive material. Other conductive or non-conductive materials, as known by those skilled in the art, could alternatively be used.

In some embodiments, the precipitators require significantly less voltage than prior art precipitators. For example, in some embodiments, the precipitator only used approximately 10,000 volts, while in prior art, 30,000-50,000 volts were required. The current level is also often lower because the distance between the input and output orifices can be significantly reduced.

The vane electrostatic precipitators described herein collect coarse and fine particles more efficiently than any prior art devices. They collect welding fumes very efficiently, indicating that they collect in the 0.01 to 1.0 micron range. Fly-ash fines can be collected on the vane surfaces and removed by impact.

In some preferred embodiments, the discharge electrodes are offset. For example, with saw tooth electrodes two teeth may be offset from each other. The band saw tooth discharge electrodes can be modified by varying the number of teeth per inch or by using either straight or offset teeth along the length.

FIG. 1 is a cross sectional view of a two chamber horizontal airflow vane electrostatic precipitator comprising several types of opposing vane electrode (1) structures (47), (48), (49) in combination with narrow orifices (12) and (13) at both ends of the precipitator. Vane configuration (47) shows opposing vanes that are evenly spaced from each other. The overall dimensions, length, width, and thickness of the vanes depend on the application and operational requirements such as flow rate (CFM), particle size, and concentration.

Vane configuration (48) shows vanes with different widths and offset from the center line of the main air stream (9). Vane configuration (49) shows a modular structure. Each modular unit includes six vanes where the vanes are of the same length except for the sixth vane (40) of the modular unit (49), which is longer in width than the other vanes (1). How close these vanes (40) are to the plate (6) is determined by the air flow operating condition. The vane (40) is closer to the plate (6) at higher flow rates. The modular vane design (49) directs the air that is flowing in back of the vanes to flow back towards the main air stream (9). While two modular units, each having six vanes, are shown in the vane configuration (49) shown in FIG. 1, different numbers of vanes and different numbers of modular units could be used (for example, see FIG. 8).

The first (27) and second (28) chamber have centrally located discharge electrodes (3) that charge the particulates and establish flux lines to the vanes for charged particles to follow. Although vane configurations (47) and (48) are shown in the first chamber (27) and vane configuration (49) is shown in the second chamber (28) in the figure, any of these vane configurations (47), (48), or (49), or combinations thereof, could be included in either of these chambers (27) and (28). What determines the selection of vane configuration, the number of fields and other configurations are the material properties and operating requirements.

FIG. 1 also includes a pre-charger (4) that preferably has discharge electrodes (3) and an attracting plate (14), and one or more re-chargers (25) or field dividers (34) that also have an attracting plate electrode (14) and at least one discharge electrode (3). The field divider (34) may have an orifice the same size as the input (12) and exit (13) orifice. The field divider (34) prevents the air from flowing directly to the next field. In effect, it makes the air go back into the previous field to be cleaned again.

In the second chamber (28) of FIG. 1, the arrangements of the vanes are designed to add more drag on the air flow and improve on collection. Perforated plates, porous, preferably mesh, material (5) or vertical wire grids (or rods) (38) are located behind the vanes in the first and second chambers (27) and (28). The porous material (5) or wire grids (38) collect particles, while at the same time adding additional drag to the air flow by allowing the air to pass through the mesh and impact either another plate or the enclosure wall (31) or impact with returning particles. Advantages of this vane design are that the charged particles immediately start to be withdrawn as soon as they pass through the input orifice (12) and meet the strong electric field (7) found at the edge (42) of each opposing vane. FIG. 1 also shows that the angle of the vanes (1) in reference to the center line can be varied to improve the collection.

Figure 2:
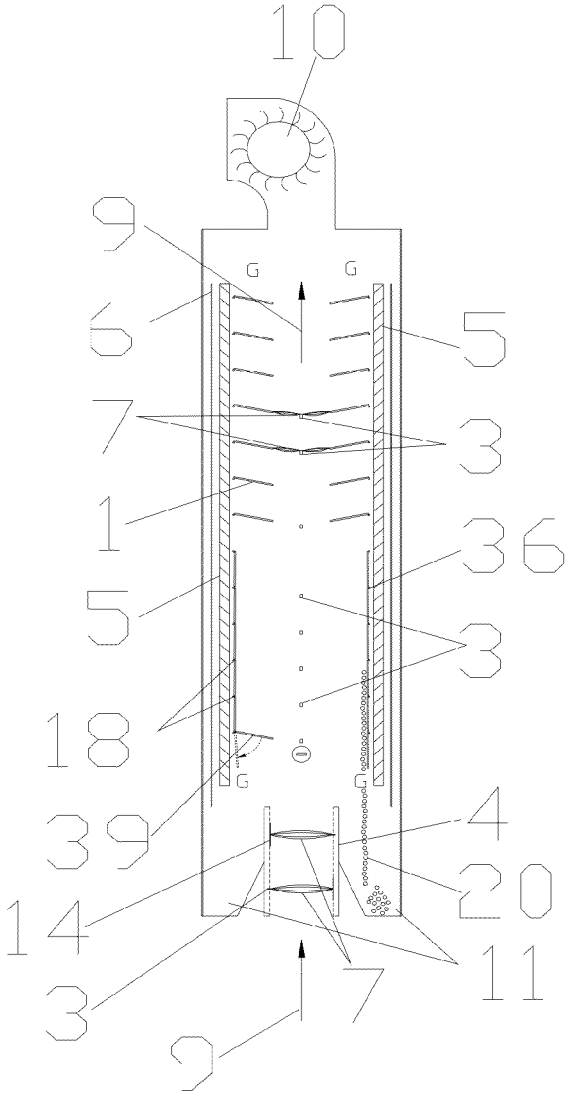
FIG. 2 shows a cross sectional view of vertical airflow through a precipitator and a vane design where the vanes are rotated for cleaning.

FIG. 2 is a cross sectional view of a vane electrostatic precipitator where the entrained air flows vertically. The main entrained air (9) is first drawn through the vane electrostatic precipitator by a blower (10) after it passes through a pre-charger (4) that has two discharge electrodes (3) and two plate electrodes (14), one on each side and offset from each other. The main air stream (9) then passes between vane electrodes (1) that are near perpendicular to the main air flow (9). Centrally located to the vanes are discharge electrodes (3) that establish an electrical field (7) between the vane electrodes (1) and the discharge electrodes (3).

Particles that are collected on the vanes (1) are removed by first rotating (39) the vanes (1) 90 degrees at the pivot point (18) into a discharge position (36) and then impacting them. Particles that are collected on mesh material (5) or the outer collection plate (6) are impacted after the vanes (1) or (2) are rotated causing these particles to fall (20) by gravity into the dust collection chamber (11) and not back into the main air stream (9). With this design, re-entry of particles should be substantially reduced or eliminated.

FIGS. 3*a* through 3*d* show cross-sectional views of the changes in the airflow when various vane designs are used in combination with various mesh or porous materials. These figures show the effect of changing the various arrangement, sizes, and contour of the vanes (1). When the arc radius of a contour vane increases, the amount of stress or drag increases on both the air flow (8) and the charged particles (16), producing eddies (17) that reduce the velocity of both the lateral air flow (8) and particles (16), resulting in more efficient collection of particles. Other factors that affect the amount of drag induced on the air and particles include the width and surface characteristics of the vanes and how they are positioned and assembled relative to the air flow and air velocity.

Figure 3A:
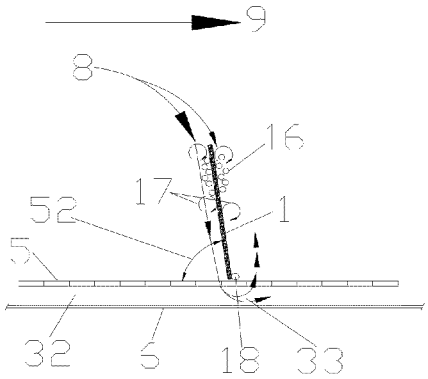
FIG. 3*a* shows a substantially vertically flat vane in an embodiment of the present invention.
Figure 3B:
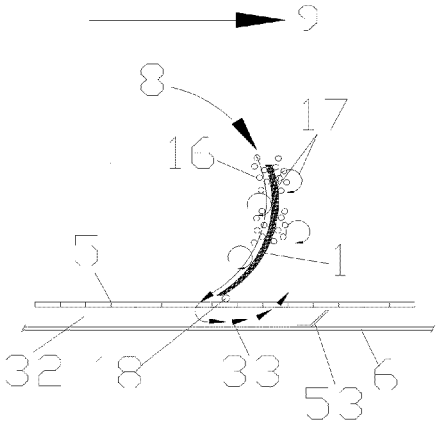
FIG. 3*b* shows a somewhat curved contour vane in an embodiment of the present invention.
Figure 3C:
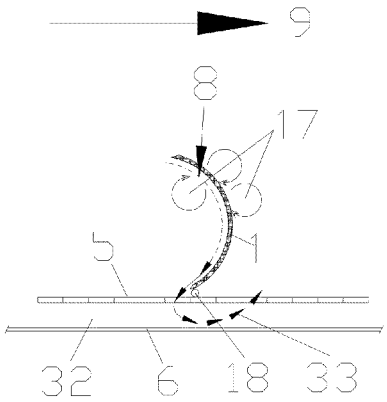
FIG. 3*c* shows a substantially curved contour vane in an embodiment of the present invention.

FIGS. 3*a* through 3*d* show flat and contour vanes and their possible eddies (17). More specifically, FIG. 3*a* shows eddies that result on both sides of a preferably hanging, straight plate vane. The amount and type of air flow interference depends on the angle of operation (52) and air flow conditions. FIGS. 3*b* and 3*c* show contour vanes with different arcs or curvatures. The greater the arc, the more interference to flow while the air that flows on the back side has eddies in the upper part of the curve and more turbulent conditions as the curve approaches the pivot point (18). FIG. 3*b* also shows the use of baffles (53) between the porous material (5) and the plate (6). A baffle (53) prevents the short circuiting of the air flow between the porous material (5) and the plate (6) so that it does not circulate back towards the main air stream (9). The baffles (53) may not be required when the length of the fields is short; for long fields, a number of baffles (53) may be required. While the baffles (53) are somewhat L-shaped in the figure, any shape that could promote air flow in the air space (32) between the porous material (5) and the plate (6) could be used. The baffles (53) could be made of a solid or mesh material. Baffles (53) could be used in any of the embodiments described herein.

Figure 3D:
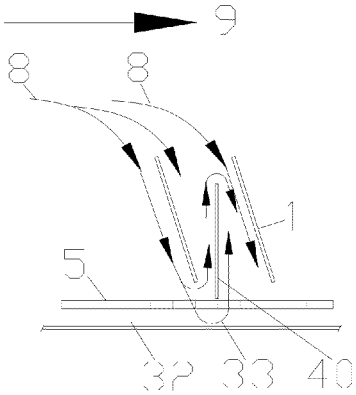
FIG. 3*d* shows a multi-vane arrangement in an embodiment of the present invention.

FIG. 3*d* shows a multi-vane arrangement, where one of the vanes (40) is closer to the porous material (5) than the other two vanes (1). The multi-vane arrangement shown in FIG. 3*d* will increase drag by causing an abrupt change in the direction of air flow. Having a short vane located between two angled vanes increases the chance of flow interference that results in improved collection.

The type of open pore structure used for the porous membrane (5) depends on the type of vanes used and the electrical arrangement. Some of the open pore materials that may be used include, but are not limited to, conductive wire or plastic mesh, or knitted metal or plastic. The porous structure selected should add resistance to flow, so minimum re-entrainment takes place during the removal of particles from the vanes (1) and the mesh material (5). In some embodiments, both conductive and non-conductive ridged mesh materials are used for the mesh or porous type material. In some embodiments, materials such as woven grids can be stretched on the bias to discharge particles that have been collected otherwise a standard impact or vibratory method can be used as part or all of the porous membrane (5).

Figure 4:
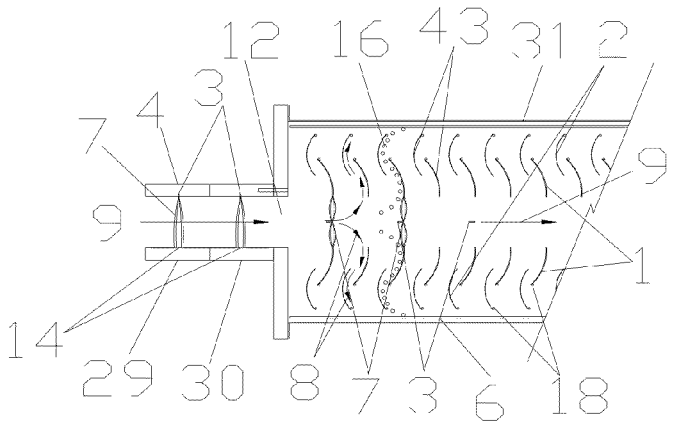
FIG. 4 shows a cross sectional top view of a vane electrostatic precipitator that uses contour dual vanes in series opposite each other in an embodiment of the present invention.

FIG. 4 is a cross sectional top view and through the center showing a vane electrostatic precipitator with opposing vane pairs on both sides of the precipitator. Similar to the other embodiments, the vanes are at ground potential such that there is no electric field between opposing vane surfaces. The opposed dual vanes (43) are in series. An electric field (7) forms between the leading edge of the interior vanes of each pair and the discharge electrodes (3) centrally located between the vanes. The dual vane (43) preferably includes a conductive vane (1) and a second vane (2), which may be conductive or non-conductive. A non-conductive vane is used in position (2) if the back plate (6) is conductive and close enough to create electrical problems. An advantage of this design is that the charged particles (16) that are flowing laterally (8) over the conductive vanes (1) will be subjected to reverse flow as they flow over the second vanes (2), adding additional drag on the particles and improving collection. The plate (6) located behind the vanes can be a solid or a porous structure that can add additional drag to the air and particle movement. External to the vane electrostatic precipitator enclosure (31) is a pre-charger (4) that is designed to have one or more pre-charging units (29) and (30), each including one or more discharge electrodes (3) and plate electrodes (14). By having multiple pre-charging units (29) and (30), adjustment can be made for variations in particle concentration or when aggregation or agglomeration of fine particles is required. When agglomeration is required, each pre-charging unit may have alternating polarity. FIGS. 1, 2 and 4 show various types of pre-chargers.

Figure 5:
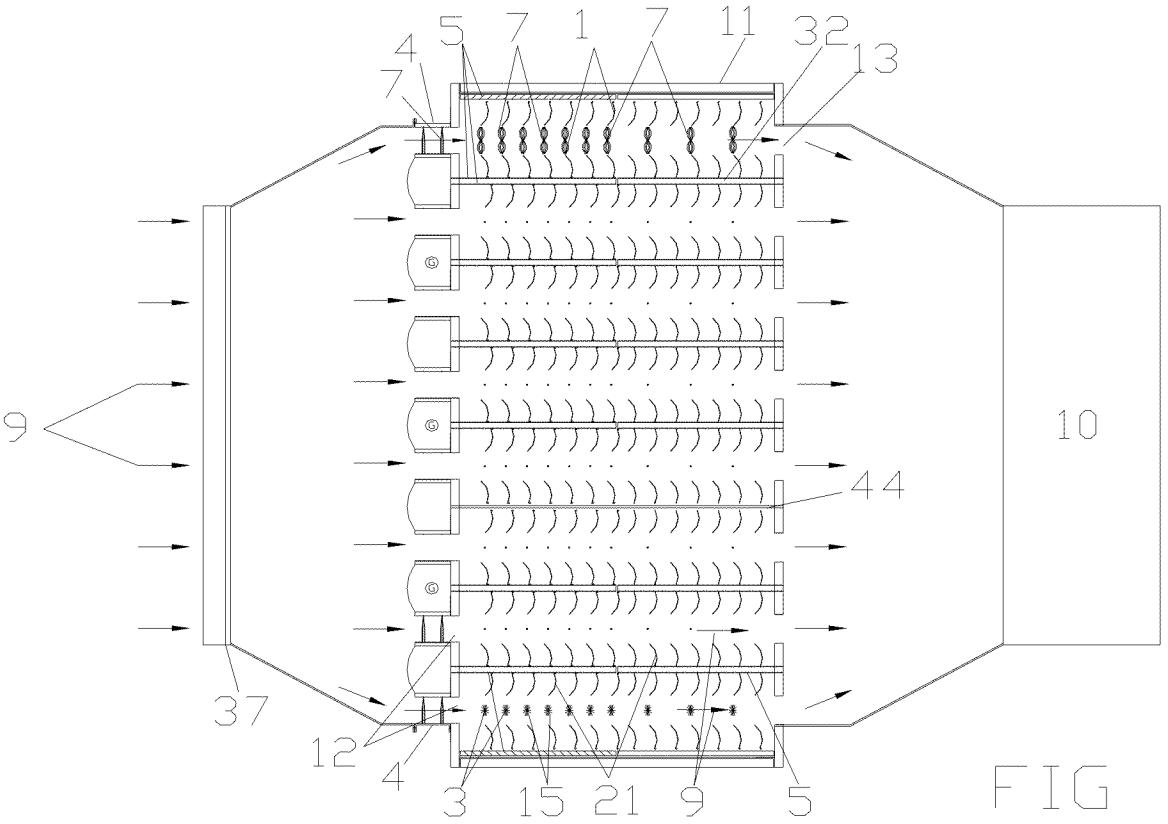
FIG. 5 shows a cross sectional center top view showing an embodiment with a multi orifice design used to increase the capacity of the vane electrostatic precipitator.

FIG. 5 is cross sectional top view showing a single field of multiple vane electrostatic precipitator chambers used to increase the capacity of a vane electrostatic precipitator. The main air flow (9) is first drawn through a porous coarse filter plate (37) and then through multiple independent input orifices (12) and exit orifices (13) by the blower (10). The physical arrangement of the centrally located contour vane electrodes (21) may use one or more designs in order to improve collection. One design shown separates the contour vanes (21) with two parallel opposing porous materials (5) that allow either collection on its surface or the air and particles to pass through and create flow interference. Another design uses a solid dividing plate (44) that would separate the chambers.

The amount of charging of the particulates (15) is dependent on the number and type of discharge electrodes (3) used, and the electrical system used. The greater the number of electrical field flux lines (7), the greater the collection.

Figure 6:
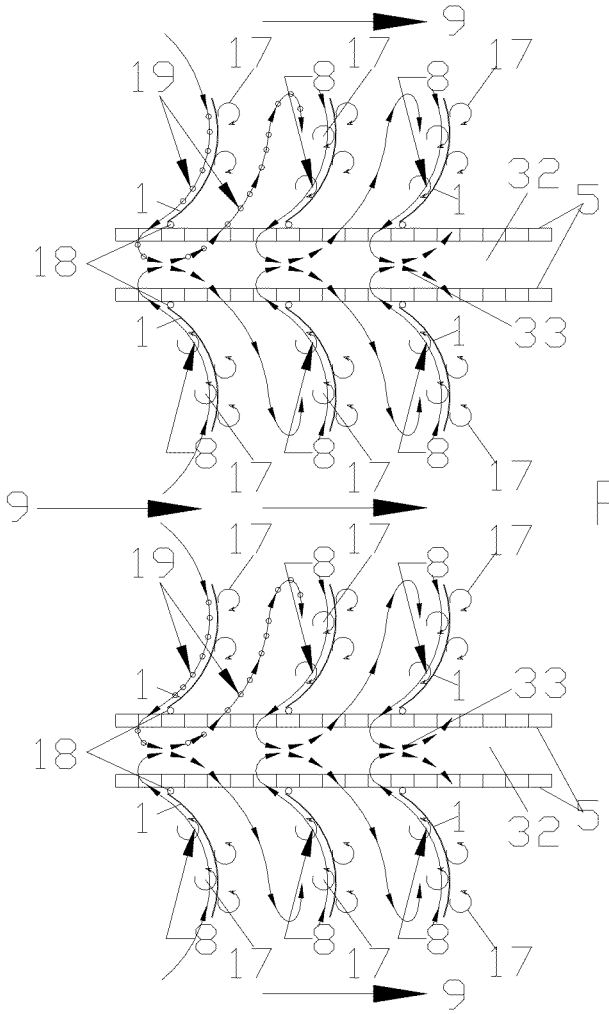
FIG. 6 shows a cross sectional view of the effect of changes on airflow in a multi-orifice vane electrostatic precipitator when a combination of a parallel and opposing mesh or grid type material are used directly behind the vanes. Also shown is an air space that can be used between the mesh materials.

FIG. 6 is an enlarged cross sectional top view of one of the electrode arrangements shown in FIG. 5. FIGS. 5 and 6 illustrate the relationship of the main air flow (9) to the contour vanes (1), the porous material (5), and the resulting lateral particle (19) and air flow (8), resulting in eddies (17) on both sides of the vanes (1). The vanes (1) are adjustable at the pivot point (18) for variations in the collection process. The air space (32) between the porous materials may be replaced with a single porous unit or a solid dividing plate (44) (FIG. 5) if required by the collection process. The air space (32) may also optionally include baffles (53) (see FIGS. 3*b* and 7).

Figure 7:
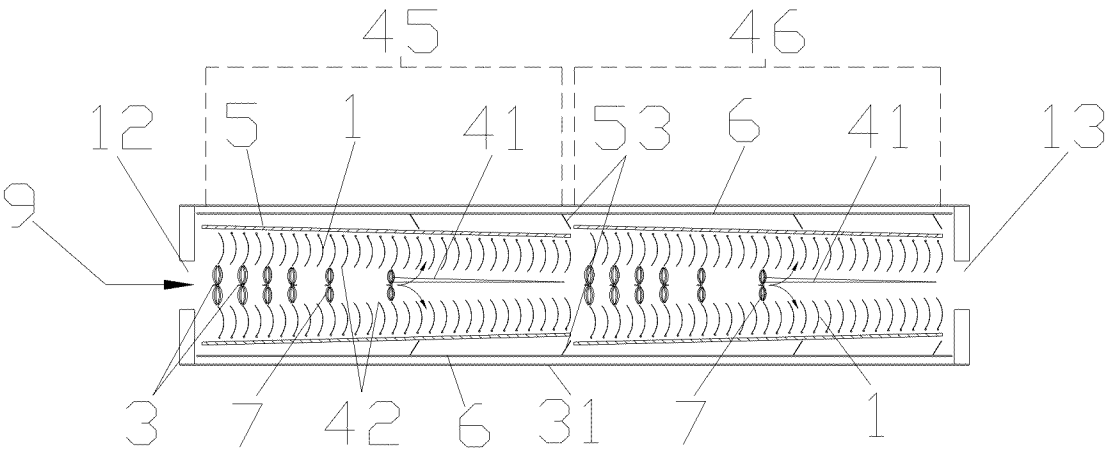
FIG. 7 shows a cross sectional view of an embodiment where the vanes opposing each other are tapered a few degrees or more towards the center with a narrow opening facing the exit end. Discharge electrodes are also shown centrally located and distributed along the length of the chamber.

FIG. 7 shows a cross sectional view of two fields (45) and (46) that have vane electrode arrangements that are tapered (41) inward towards the exit end (13). Centrally located discharge electrodes (3) are separately controlled electrically to compensate for changes in the distance between the discharge (3) and vane electrode (1). Baffles (53) behind the porous material (5) aid in circulation of the entrained air towards the main air flow (9). An advantage of this design is the gradual removal of entrained air from the main air stream (9). The combination of this vane arrangement and the corona wind generated by the discharged electrodes (3) improves the chance for good circulation of the entrained air over the vanes. The taper (41) makes it more difficult for the air to pass through the electrostatic precipitator without getting cleaned. Embodiments with a taper (41) may eliminate the end for multiple fields and/or a field divider. In this preferred embodiment, the taper will vary based on the length of the field (45), (46).

All of the various vane configurations shown in FIGS. 1 and 7 work well for the collection of fly-ash from coal burning boilers. FIG. 7 also shows the use of baffles or vanes that are used to redirect the flow of entrained air back towards the main air flow.

Figure 8:
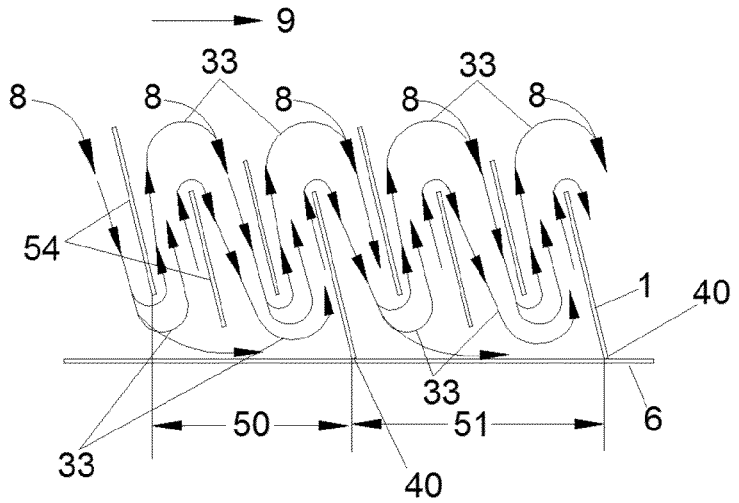
FIG. 8 shows the expected air flow for an embodiment with a four vane modular unit.

FIG. 8 shows the expected air flow (8) and (33) for two four-vane (1) modular units (50) and (51) that have vanes offset from each other and away from the main air flow (9) and towards the back plate (6). The last vane (40) in each modular unit (50) and (51) is very close to the plate (6). This combination of vane offsets (54) and modular units assures circulation of the entrained air (33) as well as improving the assembly of the vanes in the field; it should be noted that the size and the number of vanes (1), (40) in a modular unit (50) and (51) depend on application requirements. In some embodiments, the vane (40) is made of a dielectric or another nonconductive material. In some embodiments, the vane (40) is made of aluminum or plastic.

Figure 9:
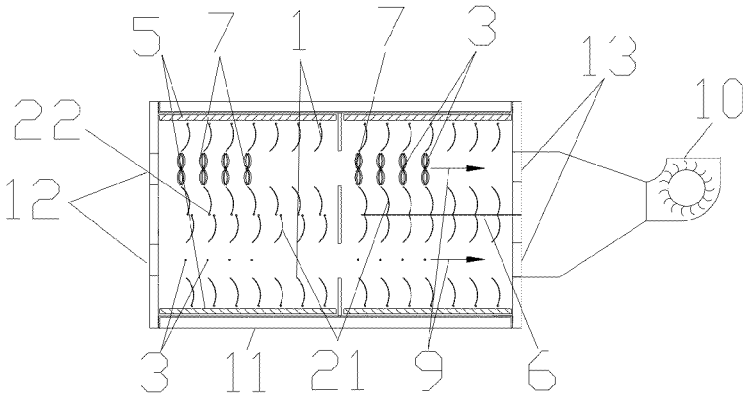
FIG. 9 is a cross sectional view of a vane electrostatic precipitator in an embodiment of the present invention.

FIG. 9 is a cross sectional top view showing a dual chamber design used to increase the capacity of a vane electrostatic precipitator. The main air flow (9) is drawn through multiple input orifices (12) and exit orifices (13) by a blower (10). The physical arrangement of the centrally located contour vane electrodes (21) may use one or more designs in order to improve collection. One design overlaps (22) each vane (21) so that the air flow from each side intersects, and on the back side of the opposite side, vanes create particle impact that reduces or eliminates particle flow. Another design separates the contour vanes (21) with a solid plate (6) or a porous material (5) that allows either collection on its surface or the air and particles to pass through the mesh and create flow interference. Either vane design could be used in either section of the electrostatic precipitator.

The devices and methods disclosed herein result in near zero particle re-entrainment. They also permit the collection of a full range of particle sizes and the collection of both conductive and high resistivity particles. The devices and methods also operate at higher air velocities, resulting in the equipment being smaller in size.

The embodiments described herein significantly increase the collection efficiency of electrostatic precipitators. The VEPs increase the collection surface area per unit length by a factor of two or more over prior art electrostatic precipitators. Also, by having the vanes at ground potential, there is no electrical field between opposing surfaces, substantially reducing the problems associated with back corona. Repeated circulation of entrained air induces enough drag on both the air and particle flow that charged particles attach to both sides of the vane surfaces. Repeated circulation of the air and particles over the vanes is more efficient than using a flat plate laminar air flow system for the collection of particulates. The embodiments have a broad design base that is able to meet different process and material requirements.

Some applications for the VEPs include, but are not limited to, collecting fly-ash particles from coal fired boilers, collecting hazardous waste, collecting glass and ceramic dust particles, collecting welding fumes (which can be between 0.01 micron and 1 micron), collecting metal dust particles, collecting and returning solid particles to a process, and the cyclone market.

An advantage of the VEPs described herein is the ability to collect particles in the lower particle size range (<2.5 microns) and reduce the dependence on bag filters. These particles may include elemental and compounds of mercury. The VEPs also realize energy savings related to elimination of filter bags. There is also a major reduction or elimination of particle re-entrainment. The VEPs are able to collect both conductive and non-conductive particles. The VEPs have a smaller equipment footprint, which leads to energy savings. The VEPs also eliminate back corona problems and can operate at a higher gas velocity than prior art electrostatic precipitators.

In some embodiments, the methods and vane electrostatic precipitators described herein improve the collection of particulates by using a high concentration of discharge electrodes per vane assembly. In one preferred embodiment, the ratio of the number of vane electrodes to the number of discharge electrodes in at least one vane assembly is less than 3:1. In a further preferred embodiment, the ratio of the number of discharge electrodes to the number of vane electrodes in at least one vane assembly is approximately 1:1. The preferred 1:1 ratio is based on having the strongest electrical field possible and this occurs when the discharge and vane electrodes are directly opposite each other. This does not imply that there are an equal number of discharge and vane electrodes in the entire precipitator. For most applications, discharge electrodes are not used near the exit end of collection chamber, but several rows of vanes are required for efficient collection after the discharge electrodes end.

In one preferred embodiment, a vane electrostatic precipitator includes a plurality of vane electrodes and the plurality of discharge electrodes in proximity to the leading edge of the vane electrodes, where a distance between the leading edge of the vane electrodes and the discharge electrode is smaller than a distance between adjacent discharge electrodes.

In preferred embodiments, methods and precipitators reduce the amount of ozone generated compared to prior art electrostatic precipitators by operating just above the power required to produce a corona discharge.

In some preferred methods, the electrical power required to generate a corona that is used to charge particles is reduced compared to the electrical power required in prior art precipitators. This is based on a number of factors, including, but not limited to, electrically operating close to the corona onset voltage, having both the vane and discharge electrodes in close proximity, and having a high ratio of discharge and vane electrodes within a vane assembly.

Figure 10:
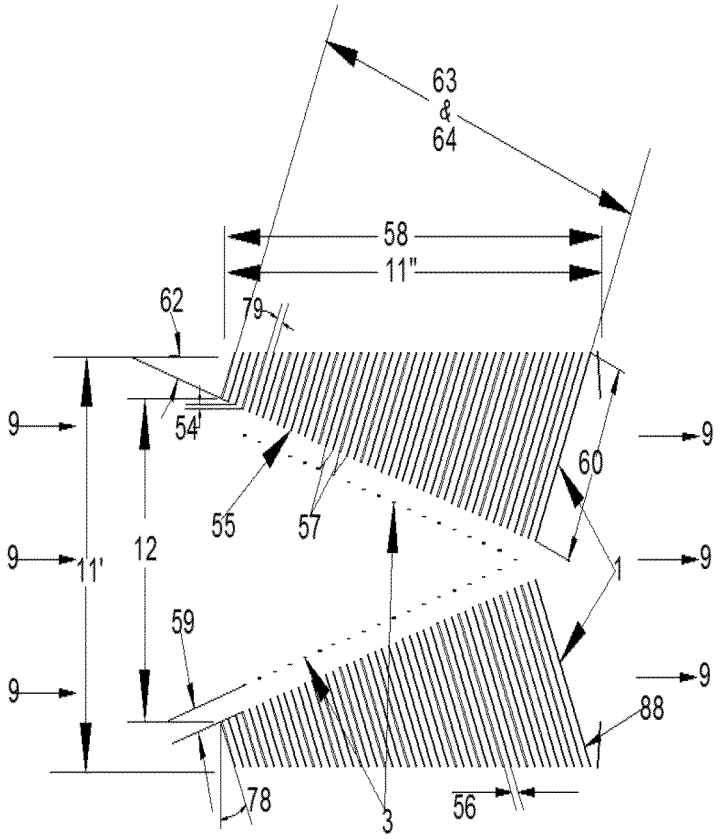
FIG. 10 shows a cross sectional view of one embodiment of a vane assembly found in a single chamber with various components that affect efficient collection.

FIG. 10 shows a vane electrostatic precipitator in an embodiment of the present invention. Air flow (9) enters through an input orifice (12). FIG. 10 shows some of the main factors that affect how the vane electrostatic precipitator functions. These include the vane operating angle (78), the distance (79) between vanes (1), the total vane surface area (88) (which includes the surface area on both sides of each vane) per collection chamber (11), the amount of offset (54) of the vanes (1), the vane width (60), the vane assembly angle (62), the number (57) of vanes (1) per collection chamber (11), and the number of vanes (1) per the number of discharge electrodes (3). The number of vanes per field and the vane area per field are related to the selection of the type of vane (1) design and to the desired efficiency of a vane electrostatic precipitator.

Note that the collection chamber (11) includes the width (11'), length (11"), and height (not shown) dimensions. The vane width (60) in a vane group (63) (two or more vanes that are grouped together to operate with the same operating parameters) may be constant or may vary along the length of the field (58), as shown in FIG. 10.

In developing the vane electrostatic precipitator, several new factors were discovered that have a major bearing on the collection efficiency of the vane electrostatic precipitator. These include the vane offset (54), the distance (59) the discharge electrodes (3) are from the leading edge (55) of the vane electrodes (1) and the vane assembly angle (62).

The vane offset (54) refers to how much longer the next vane (1) is in relation to the preceding one. This offset (54), in combination with the distance (79) between a vane pair (two vanes) (56) determines the percent of the main air flow (9) that is expected to flow between each vane pair (56). The distance (79) between the vane pair (56) is preferably measured between the inside surface of each of the vanes (1) in the vane pair (56).

Figure 11:
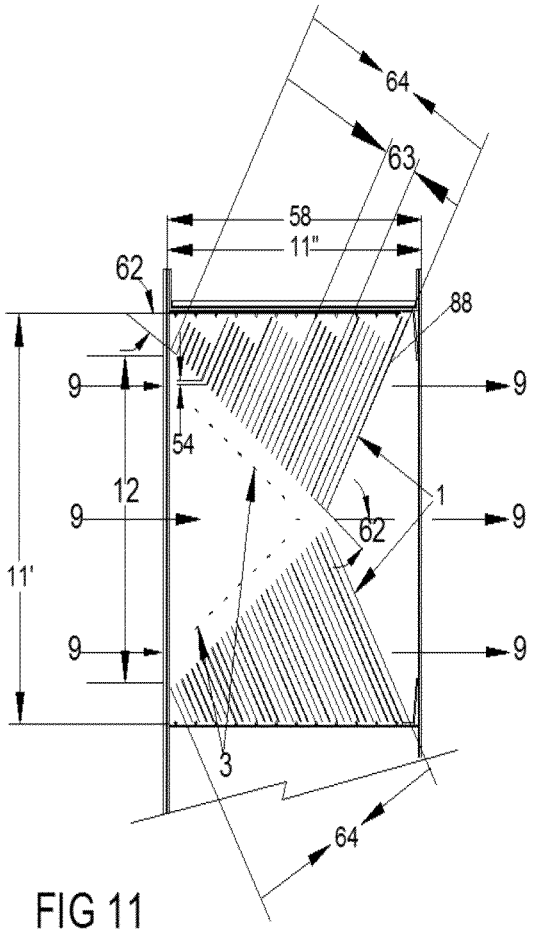
FIG. 11 shows a cross sectional view showing the saw tooth discharge electrodes aligned to be in the direction of the main air flow and to follow the leading angle of the vane electrodes.

The greater the offset (54), the larger the percentage of air diverted from the main air stream (9). This results in a number of other changes, including that the air flow rate increases with less flow interference, resulting in the possibility that vanes with a larger surface area are required but at the same time a lower number of vanes are used per chamber, as shown in FIG. 11. FIG. 11 has approximately 1½ times greater vane offset (54) than FIG. 10.

FIG. 10 also shows that the main air flow (9) is divided into 90 individual air streams (one air stream between each set of adjacent vanes). This embodiment with such a large number of vanes would only be used in applications with a very high flow rate. Other design parameters, such as vane length, vane offset, vane spacing, would also be chosen to match the operational requirements of the application.

The type of discharge electrodes (3) (for example saw tooth discharge electrodes as shown in all four figures), the number of discharge electrodes (3), the position of the discharge electrodes (3), either parallel to the main air flow (9) or parallel to the vane operating angle (78), and the number of vanes (1) required per discharge electrode (3) are based on factors related to the type of material being processed and the power restrictions. In preferred embodiments, the discharge electrodes (3) are parallel to the main air flow (9) (as shown in FIG. 10). This reduces the power needs of the vane electrostatic precipitator, as well as making the charging process more efficient. In some embodiments, distances of approximately 1 to 2 inches between the leading edge (55) of the vane (1) and the discharge electrodes (3) are preferred.

If circular wire discharge electrodes (3) are used, the directional placement in relation to the vanes (1) is not an issue, just the location. For this particular application. the saw tooth discharge electrode (3) is the preferred choice because of its uniformity of discharge along its length and, depending on its size, can affect the air flow.

The selection of the vane operating angle (78) and the vane width (60) are dependent on a number of factors, but one of the major factors is related to the amount of drag or interference to the flow that is required to meet the desired collection vane exit flow rate of less than <1 ft/s. Sharper angles (78) and wider (60) vanes (1) increase the interference to flow.

The distance (79) between the vanes (1) can have two effects on the process. It can determine whether both sides of the vanes (1) collect particulates and the amount of turbulence or drag induced on the entrained air. Collecting on both sides of the vanes is a desirable feature because it also reduces the overall length of the vane electrostatic precipitator. For applications where the particle concentration per cubic centimeter is high, the distance (79) between the vanes may have to be increased.

The required vane surface area (88) per collection chamber (11) and the number of fields (58) are related to the actual cubic feet per minute (ACFM) of air flow and the desired efficiency of the vane electrostatic precipitator.

Figure 12:
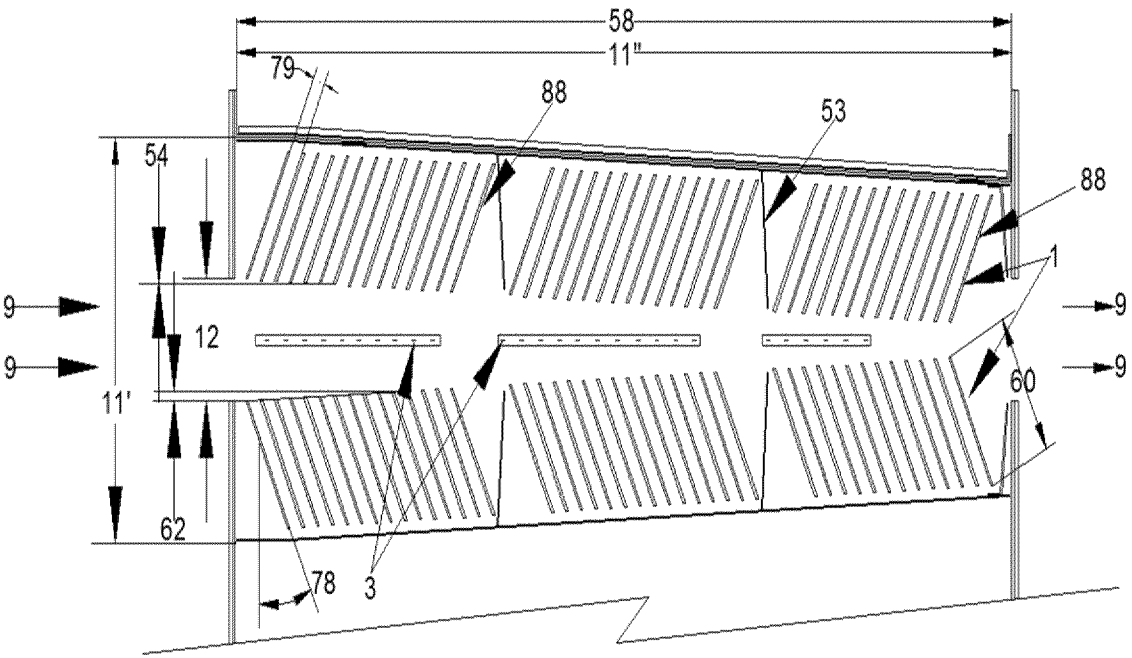
FIG. 12 is a cross sectional view of a vane electrostatic precipitator where the vane assembly angle is small in order to achieve high cubic flow per minute (CFM) using high air flow rates.

FIG. 12 is cross sectional view of a vane electrostatic precipitator where the air flow rates are very high (>20 ft/m) in order to achieve a high volume of air flow (CFM).

FIG. 12 shows the vane assembly tapered from front to back and towards a center of the main air flow of the collection chamber, which improves control and efficiency of collection of the particles.

FIG. 12 shows a vane assembly angle (62) of approximately 1 to 3 degrees, while in FIGS. 10 and 11, the vane assembly angles (62) are preferably at 16 and 30 degrees, respectively. For efficient operation, the ratio of field length (58) to the aperture input orifice opening (12) is high and the vane offset (54) is very small because of the higher volume of air flow each vane is expected to handle. The discharge electrodes in FIG. 12 are centrally located and are assembled into groups that operate at different power levels.

FIG. 12 shows an example of an operating unit where the field length (58) is 40 inches, the input orifice (12) is 4.37 inches, and the vane offset is 0.025". The ratio of field length (58) to the aperture/input orifice opening (12) is approximately 9:1. The small vane offset and the high ratio of the field length (58) to the aperture/input orifice opening (12) has resulted in efficient collection of particles. These dimensions are examples only, and the preferred dimensions for each application will depend on process requirements.

Figure 13:
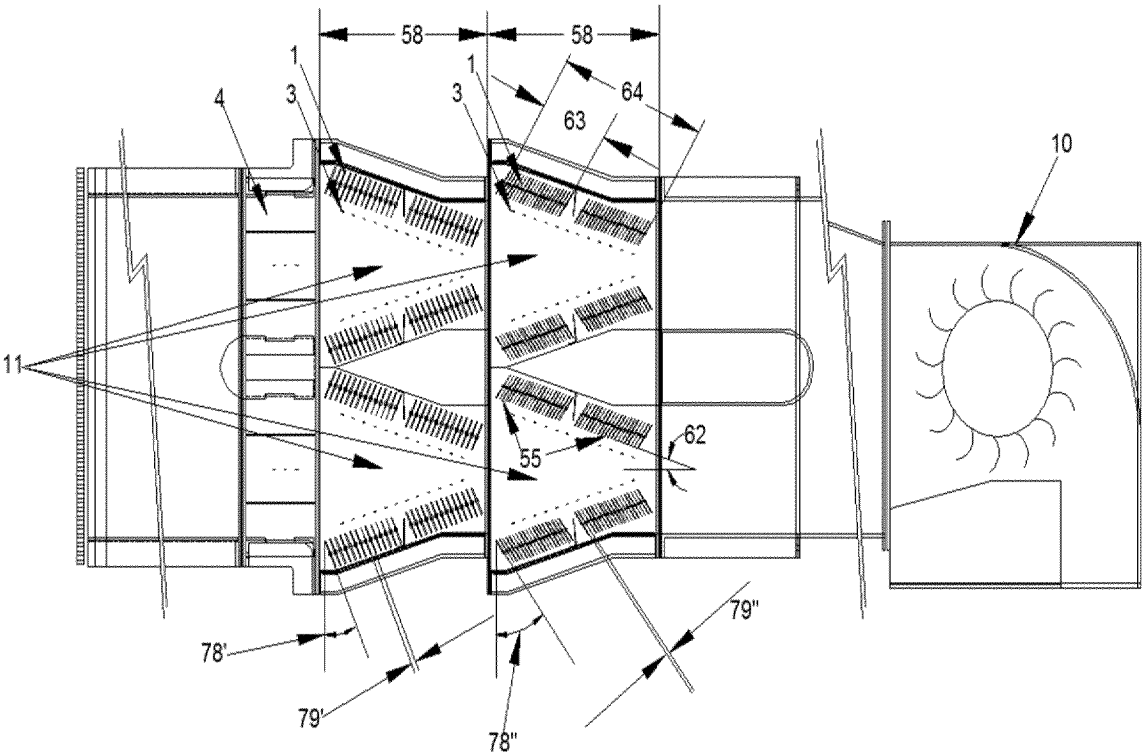
FIG. 13 shows a cross sectional view of a vane electrostatic precipitator that has two fields and four collection chambers.

FIG. 13 shows a cross sectional view of a vane electrostatic precipitator assembly that has a pre-charger (4), a two-field (58), four-chamber (11) vane electrostatic precipitator that has vanes (1) preferably set at 25 degree (78') and 42 degree (78") angles with two different spacing's (79') (79") between the vanes (1). A blower (10) is also shown. FIGS. 10, 11 and 13 also show the discharge electrodes (3) in a V-shape arrangement. This arrangement is more effective in charging the particulates when the vane assembly angle (62) becomes large, resulting in less power being required because of the closer proximity of the vanes (1) to the discharge electrodes (3).

FIG. 13 shows how the vane assembly angle (62) is equal to the angle the leading edge (55) of the vanes (1) makes with the center line of the main air flow (9). The selection of the vane assembly angle (62) is based on the foot print restrictions, air flow rates, and capacity requirements. FIG. 13 also shows how the vane assembly (64) can be divided into groups (63) for making the collection process and the fabrication both more efficient.

Figure 14:
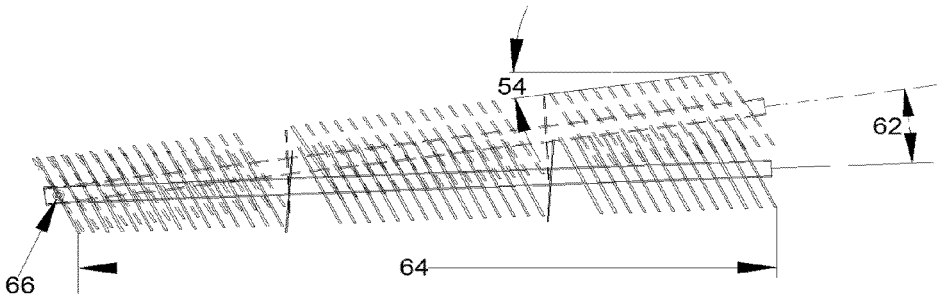
FIG. 14 shows a cross sectional view of a vane electrostatic precipitator where the vane assembly angle is changeable during operation.
Figure 15:
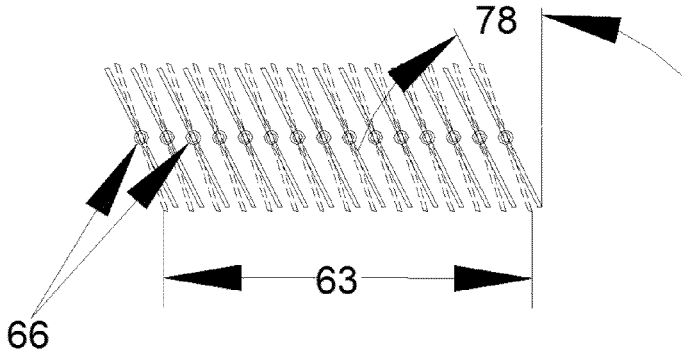
FIG. 15 shows a cross sectional view of a vane electrostatic precipitator where the vane operating angle is changeable during operation.

Other desirable operating features that will in some cases improve on the collection of particulates are the ability to change the vane assembly angle (62) and/or the vane operating angle (78) during operation. FIG. 14 shows the vane assembly (64) rotated at the pivot point (66) to a desired position. FIG. 15 shows a vane group (63) and the pivot points (66) for adjusting the vane operating angle (78). An advantage of these capabilities is related to the ability to adjust for major changes in operating temperature or mass flow (particle concentration), especially during the start up of the process.

Studies have shown that with a larger number of discharge electrodes per vane assembly, the collection process is more efficient for both coarse particles and fine particulates. An electrode arrangement where the leading edge of the vanes are opposite the discharge electrodes results in a strong concentrated electrical field for the charged particles to follow and induces a high voltage pulse effect on the charged particles as they pass by successive combinations of vane and discharge electrodes, causing the particles to more efficiently follow the concentrated electrical field flux lines to the vane.

In some embodiments, there is a one inch distance between discharge electrodes (3) and a ⅝ of an inch distance from the leading edge (55) of the vane electrode (1) to the discharge electrodes (3). In other embodiments, the distance between the discharge electrodes (3) and the leading edge (55) of the vane electrodes (1) is ¾ of an inch and the distance between the discharge electrodes is one inch. Both electrode arrangements produce excellent (>99%) collection.

Figure 16:
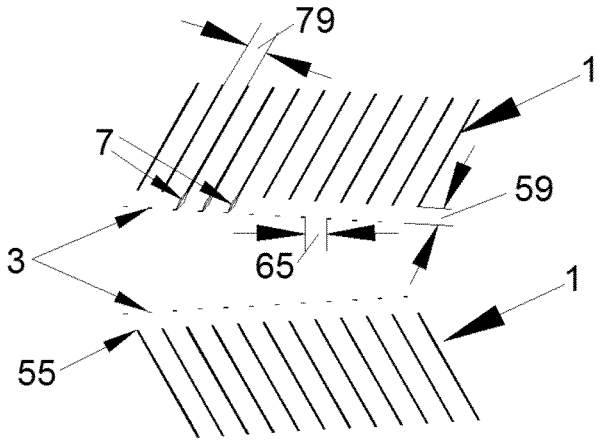
FIG. 16 shows a horizontal cross sectional view of a vane electrostatic precipitator tapered vane assembly electrode arrangement used to achieve a high CFM, where a 1:1 ratio is used for the number of vanes and discharge electrodes.

The use of a large number of discharge electrodes is illustrated in FIG. 16. In a preferred embodiment, there is a 1:1 correspondence between the number of vane electrodes (1) and the number of discharge electrodes (3) in at least one vane assembly. Since this is a tapered arrangement of the vane electrodes (1), each individual vane (1) has a corresponding discharge electrode (3). This electrode arrangement is possible if the distance (59) between the leading edge (55) of the vane electrode (1) and the discharge electrode (3) is shorter than the distance (65) between the discharge electrodes (3). If the distance (59) is not smaller than the distance (65), electrical interference occurs and reduces the amount of corona. This electrode arrangement assures that a strong electrical field (7) is maintained between the leading edge (55) of the vane (1) and the discharge electrode (3).

Using the electrode arrangements described, the vane electrostatic precipitator operates with a lower amount of electrical energy, but still has excellent collection and generates less ozone. This is accomplished by operating the vane electrostatic precipitator voltage and current just above the onset of a corona discharge. In contrast, the standard electrostatic precipitator practice is to operate with as high voltage and current as possible between the discharge and plate electrodes in order to achieve efficient collection.

Figure 17:
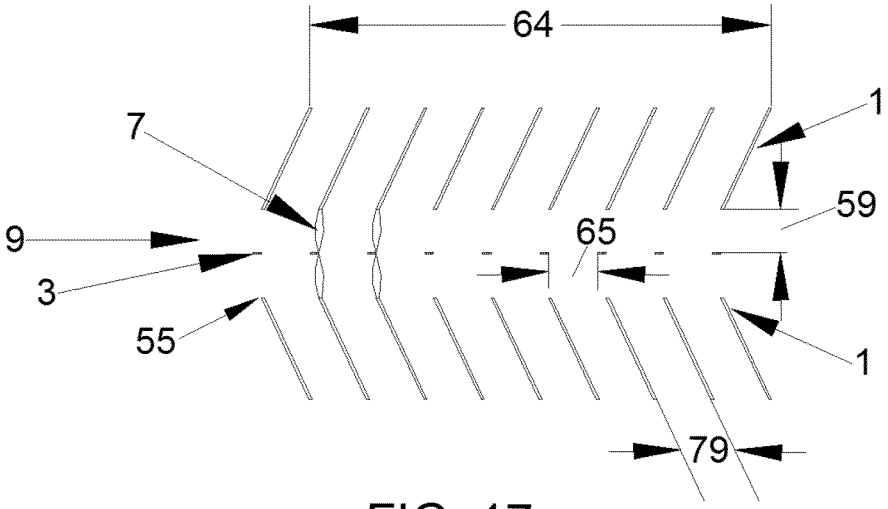
FIG. 17 shows a horizontal cross sectional view of a vane electrostatic precipitator parallel vane electrode arrangement where there is a 1:1 ratio between the number of vane electrode pairs and the discharge electrodes in a vane assembly.

FIG. 17 shows a vane electrostatic precipitator electrode arrangement having both a large number of opposing vane electrodes (1) (in a vane assembly (64)) on each side of the precipitator with a matching number of discharge electrodes (3), as well as having the discharge electrodes (3) located directly in line with the leading edge (55) of the vane electrodes (1). As in FIG. 8, the distance (59) between the leading edge (55) of the vane electrode (1) and the discharge electrode (3) is preferably shorter than the distance (65) between the discharge electrodes (3). If the distance (59) is not smaller than the distance (65), electrical interference occurs and reduces the amount of corona. This electrode arrangement assures that a strong electrical field (7) is maintained between the leading edge (55) of the vane (1) and the discharge electrode (3).

As discussed above, the preferred 1:1 ratio between the vane electrodes (1) and the discharge electrodes (3) in at least one vane assembly (64) is based on having the strongest electrical field as possible, and this occurs when the discharge (3) and vane (1) electrodes are directly opposite each other. This does not imply that you have an equal number of discharge (3) and vane electrodes (1) in the entire precipitator. In some applications, the discharge electrodes (3) are not used near the exit end of the collection chamber, but additional vanes (1) are used after the discharge electrodes (3) end. The vane assemblies (64) have a 1:1 ratio between the discharge electrodes (3) and the vane electrodes (1) in each vane assembly (64). However, the vane assemblies (64') do not have discharge electrodes (3) at the exit end of the collection chamber.

Vane assemblies (64) and (64') are groups of vanes that are structurally assembled as one unit. The number of vanes assemblies (64), (64') used in a precipitator for a particular application depends on a number of factors. The primary factor is the air velocity. With higher air velocity, the vanes are preferably wider and more vane assemblies may be required.

While some preferred dimensions are discussed throughout this application, these dimensions are examples only, and the preferred dimensions for each application will depend on process requirements.

Some examples of discharge electrodes (3) that could be used include, but are not limited to, circular, wire, saw tooth (shown in the figures), or other discharge electrodes (3) known in the art.

The spacing (65) between the discharge electrodes (3) preferably closely matches the spacing between the vanes (79) in a vane assembly and is somewhat dependent on the type of discharge electrodes (3) used.

A mathematical formula given below shows the significance and sensitivity of the current density to the distance (59) (L) between the leading edge of the vane electrodes and the discharge electrodes:

$$j=\mu PV^2/L^3$$

where j=maximum current density ($A/m^2$)

μ=ion mobility ($m^2/V_s$)

P=free space permittivity ($8.845\times10^{-12}$ F/M)

V=applied voltage (V)

L=shortest distance from discharge electrode to collecting surface (vane) (m).

("Sizing and Costing of Electrostatic precipitators, Part 1", James H. Turner, Phil A. Lawless, Toshiaki Yamamoto and David W. Coy, Research Triangle Institute, 1988, published in the *Journal of Waste Manage Association*, Vol 38, No 4, Pg. 462, herein incorporated by reference).

Listed below are a number of design parameters and operating variables that need to be considered and can be addressed by using computer modeling or by pilot model operating data, where some of the variables could be adjusted during the process to obtain the most efficient collection. All of the parameters plus others not mentioned are considered and may be varied in embodiments discussed herein to improve collection and efficiency of the vane electrostatic precipitator.

Design Parameters and Operating Variables to Consider for the Vane Electrostatic Precipitator a) Vane operating angle
b) Distance between vanes
c) Offset distance between vanes
d) Vane assembly operating angle
e) Number of vane assemblies versus ACFM (Absolute Cubic Feet per Minute)
f) Number of vane groups in a vane assembly
g) Vane assembly operating angle
h) Input air flow rate: (Absolute Cubic Feet Per Second, ACFS) versus width of vanes
i) Operating angle of discharge electrode versus vane assembly angle
j) Vane collecting area per ACFS
k) Type of vane, straight or contour and material
l) Surface area per vane
m) Number of vanes in a vane group
n) Dimensions of vane (thickness, width, height, arc) (note: each vane may have a different width)
o) Operating angle of discharge electrode versus direction of air flow
p) Number of discharge electrodes per collection chambers
q) Type and size of discharge electrode
r) Angle and number of discharge electrodes per vane
s) Spacing between discharge electrodes
t) Distance between leading edge of vane and discharge electrodes
u) Properties of dust to be collected
v) Dust concentration
w) Operating temperature (° C.)
x) ACFM required
y) Input air flow rate: (ACFS) versus number of fields
z) Plate collection area per ACFS
aa) Operating pressure (in w)
bb) Migration velocity of particle to plate
cc) Migration velocity of particle to vane
dd) Aperture dimensions
ee) Field, number and dimensions
ff) Number of fields per collecting chamber
gg) Collection chamber dimensions
hh) Power: (KW/ACFM) per collecting chamber
ii) Operating voltage (DC) per discharge bus bar
jj) Operating current per discharge bus par
kk) Power per discharger bus bar
ll) Baffles, type, porous or solid In some of the present embodiments of a VEP, there is no longer a need for a narrow input and output apertures to achieve the same capability of processing high volumes of entrained air as a standard ESP. Another advancement is the VEP's capability to not only achieve lateral air flow but in subdividing the main air flow so that smaller portions of the entrained air have to be charged and processed. This air is directed to flow between vanes that induce a drag on the entrained air, lowering the air flow rate to the desired rate of below 1 ft/sec (0.305 m/s).

Figure 19:
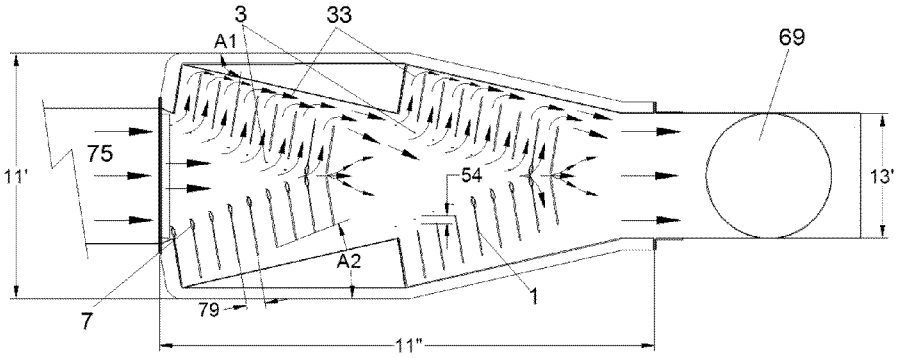
FIG. 19 shows a cross-sectional view of a vane electrostatic precipitator with a model (I) vane configuration.

FIG. 19 shows a cross sectional view of a two field mirror image VEP designed for application in the small coal fired furnace industry. This VEP divides the main air stream (33) into 16 individual air streams per field and can efficiently collect particulates moving above the normal input flow rates of 5 to 6 ft/sec. In one preferred embodiment, arranging this is accomplished by using a vane assembly that is set near 10 to 25 degrees from the main air flow while the vane operating angle is set from 5 to 95 degrees from the main air flow. Using a more shallow angle changes the profile of the VEP; it is narrow and longer, which allows more time for the main air flow rate to slow down. Efficient collection has been achieved using flow rates as high as 20 ft per second at the blower input. This model can run at a high input velocity (for example 10m/s, which is equivalent to 18 ft/s). The air is slowed down as it travels through the precipitator. This model is particularly useful for small units. For example, this model could be used in domestic coal fired furnaces (see FIG. 28).

Some examples of the dimensions that could be used in the precipitator design of FIG. 19 include a 15.75 inch chamber width (11'), an output orifice width (13') of 8.00 inch, and a 31.75 inch chamber length (11"). Other example dimensions include a 0.25 inch offset (54) between the vanes (1), a 1.00 inch distance (79) between the vanes, a 81° angle (A1), and a 21° angle (A2). These dimensions are examples only, and the preferred dimensions for each application will depend on process requirements. The input ducts (68) and output ducts (69) vary depending on the application.

Figure 20:
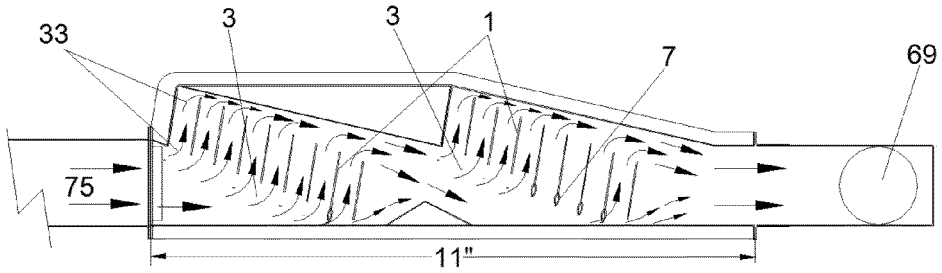
FIG. 20 shows a cross-sectional view of a vane electrostatic precipitator with a model (J) vane configuration, used for lower CFM requirements.

FIG. 20 shows how the model (I) can be modified to model (J) for lower CFM applications by using a single row, two field VEP. As an example, the chamber length (11") in this embodiment may be 16.00 inches.

Figure 21:
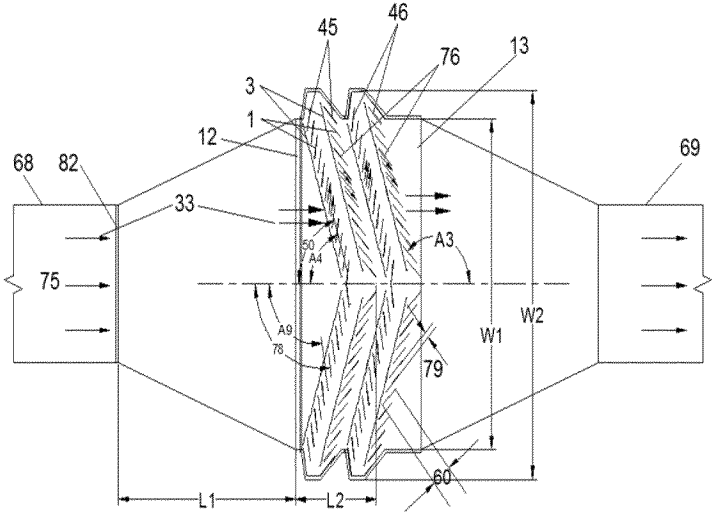
FIG. 21 shows a cross-sectional view of a vane electrostatic precipitator with a model (L) vane configuration, which includes the counter-flow vane configuration, used for higher CFM requirements.

FIG. 21 shows a cross-sectional, two field, counter flow model (L) that divides the main air stream (33) into 24 individual air streams and is designed for larger coal fired furnaces that have larger CFM requirements. This model has vane assemblies (50) that operate at a much steeper angle (A4), while the individual vane operating angle (78) is offset from main air flow or from the center line of the equipment. Another angle shown (A3) is for the counter flow vane. In one example, angle (A4) is 71 degrees, angle (A9) is 99 degrees from main air flow or from the center line of the equipment, and angle (A3) is 136 degrees. Some examples of lengths and widths of the precipitator chambers include 72 inches (L1) and 32 inches (L2) for length dimensions, and 100 inches (W1) and 118 inches (W2) for width dimensions. One example of an output orifice width (13') is 48 inches. Different angles, as well as differences in the vane width, length and distance between vanes will vary based on process requirements.

The Model (L) shown in FIG. 21 is designed to have a preferred distance between vanes (79) of 4.0 to 6.0 inches and a preferred vane width (60) of 7.0 to 12 inches. Vanes having these dimensions plus an overall preferred length of between 20 to 40 feet for the precipitator may require a contour mainly to add structural stiffness to the vane. In some preferred embodiments, a 12 inch wide contour vane with less than a 13 degree minor arc or bow is used. These embodiments can reduce the vane width by almost one sixth its original length. In other embodiments, the plurality of contour vanes have less than a 30 degree minor arc.

Another improvement is related to how effective particles are charged. With the standard ESP, the distance between discharge electrodes and the plate electrode are relatively large, resulting in the electric field being distributed over a relatively wide area and the emission intensity or the charging capability diminishing towards the plate. In contrast, in the VEPs disclosed herein, the distance between the discharge and vane electrodes is relatively close, resulting in the electrical field being more concentrated and intense between the discharge and leading edge of the vane. This results in improving both the charging of particulates and the lateral movement of the particles, as shown in FIGS. 18-20. FIG. 21 shows a design that uses the counter flow vane design and wider distances between the vanes, allowing for two or more discharge electrode per vane electrode. All of the designs shown in FIGS. 18-21 illustrate the versatility of the different vane designs.

In preferred embodiments, the VEP achieves a flow rate of less than 1.0 ft/sec at the surface of the vane electrode during the collection and discharge of the dust. The VEP achieves this by having the entrained air flow meet resistance and turbulence between the vanes so that when the air flows over and between the collecting vane surfaces at a gradual decrease in the flow rate, the charged particles are effectively transferred to the vane surface.

The lower flow rate also achieves another objective: collected particles that are discharged from the vane surface flow away from the main air flow and into an area where the air flow is substantially reduced. This results in potentially eliminating particle re-entrainment.

The VEPs also improve on the collection of the more difficult highly resistant and conductive materials.

There are numerous benefits of the VEPs described herein over standard ESPs. The VEPs increase collection surface area per unit length by a factor of (2) or more. By using repeated circulation of entrained air over vanes, enough drag is induced on both the air and particle flow that charged particles attach to both sides of the vane surfaces. Air flow rates over the vane collecting surface and between the vanes is reduced to the desired 1.0 ft/sec flow rate. By having the vanes at ground potential, there is no electrical field between opposing surfaces, substantially reducing the problems associated with back corona. The VEPs have a broad design base that is able to meet different process and material requirements.

The VEPS efficiently collect particles below 2.5 microns and reduce the dependence on bag filters that are used for this purpose. The VEPs also operate at much higher air velocity, preferably >15 ft/s. The air velocity is extremely low at the powder discharge points, resulting in substantially reducing or even eliminating re-entrainment. A VEP includes the potential of collecting the mercury compounds, because of its ability to collect both conductive and non-conductive particles. A VEP introduces energy savings related to elimination of filter bags, energy savings related to the proximity/closeness of the discharge and vane electrodes, and energy savings based on a smaller footprint. The VEP also has better collection because of intense field strengths between discharge electrode and leading edge of vanes. With some VEP models, adjustment of the operating angle and the vane assembly angle during operation will be possible. This is desirable for some start up processes. The VEPs also have a more efficient collection per linear foot.

In one preferred embodiment, a Vane Electrostatic Precipitator (VEP) uses 1.25"×15.0"×0.060" rectangular vanes to control the air flow so that the entrained charged particles are continuously subjected to a stress in the form of drag as they flow in front and behind vanes electrodes. Centrally located baffles are used to return the processed entrained air to the main air streamed to be recharged and flow back into another set of vane assemblies.

The VEP is not based on the standard ESP technology of trying to achieve laminar air flow over the collecting plate surface. Efficient collection is achieved by operating with opposing, mirror imaging vane assemblies set at a specific angle and with the individual vanes in the vane assembly set to a specific operating angle. Each vane assembly is similar to what is called a field by the ESP industry.

The other feature that affects collection is the amount of offset each vane has relative to the previous vane. The amount of offset, the number of vanes in an assembly and the operating angle of the vane assembly determine the amount of the main air flow, (CFM) that is continuously diverted and circulated.

Figure 22:
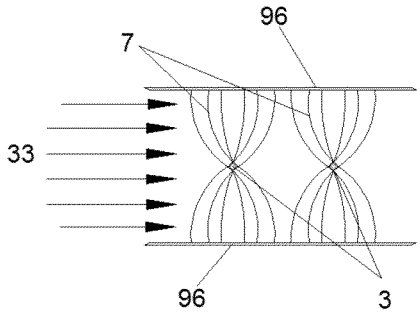
PRIOR ART FIG 22
FIG. 22 shows a prior art standard ESP plate to discharge electrode configuration and the resulting electric field distribution.

Another asset is related to how the electrical field is concentrated between the discharge electrode and the leading edge of the vane electrodes. FIG. 22 illustrates the standard ESP electrode configuration and electric field. As an example, the distance between the discharge electrode (3) and the plate electrode (96) in the prior art is typically approximately 6 to 12 inches.

Figure 23:
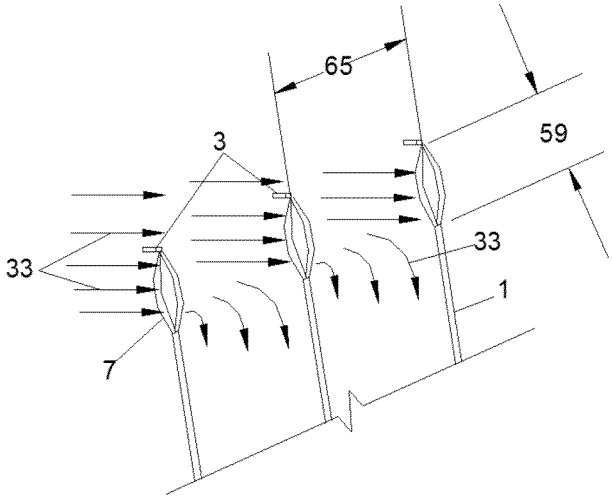
FIG. 23 shows a preferred VEP vane to discharge electrode configuration and the resulting electric field distribution.

FIG. 23 shows all the entrained air (33) passing through an electric field (7) that has been established between the discharge electrodes (3) and the leading edge of the vane electrode (1), where the flux lines will direct the charged particles to move laterally towards the vane electrode. In one example, the distance (65) between adjacent vane electrodes (1) is over 1 inch, and the distance (59) between the vane electrodes (1) and the discharge electrodes (3) is between 0.75 and 1 inch.

A high intensity electrical field (7) will increase the charged particle velocity or the drift velocity of the particle in the direction of the vane and subdivide the main air flow so that the particles are diverted and deflected by how the vane assembly operating angle and vane offset are set. Note the greater the offset, the larger amount of CFM is processed by the vane pair.

One of the formulas used for drift velocity illustrates this point, $\mu = EcEp/2\pi\mu[\in(\in+2)]$, $\mu$=particle velocity, Ec=charging field, Ep=precipitating field, $\mu$=gas viscosity, $\in$=Dielectric constant Another formula of interest is used to estimate the collection efficiency. The formula for standard plate ESP's is, $\eta = 1 - \exp(-Lu/sU)$, $\eta$=collection efficiency, L=plate length, u=drift velocity, s=discharge wire to plate spacing, U=gas velocity For the VEP it may take the form of: $\eta = 1 - \exp(-VA\ u\ D\ V\ V_O/VS\ VD\ U)$ VA=vane surface area, VS=discharger to vane leading edge, V=number of vanes per field, D=ratio of the number of discharge electrodes to number of vanes, Vo=vane offset, VD vane distance between vanes.

One of the methods for scaling up or down the VEP for different operating requirements uses the ratio of the area of the main input aperture, divided by accumulative aperture area in the vane assembly.

Figure 28A:
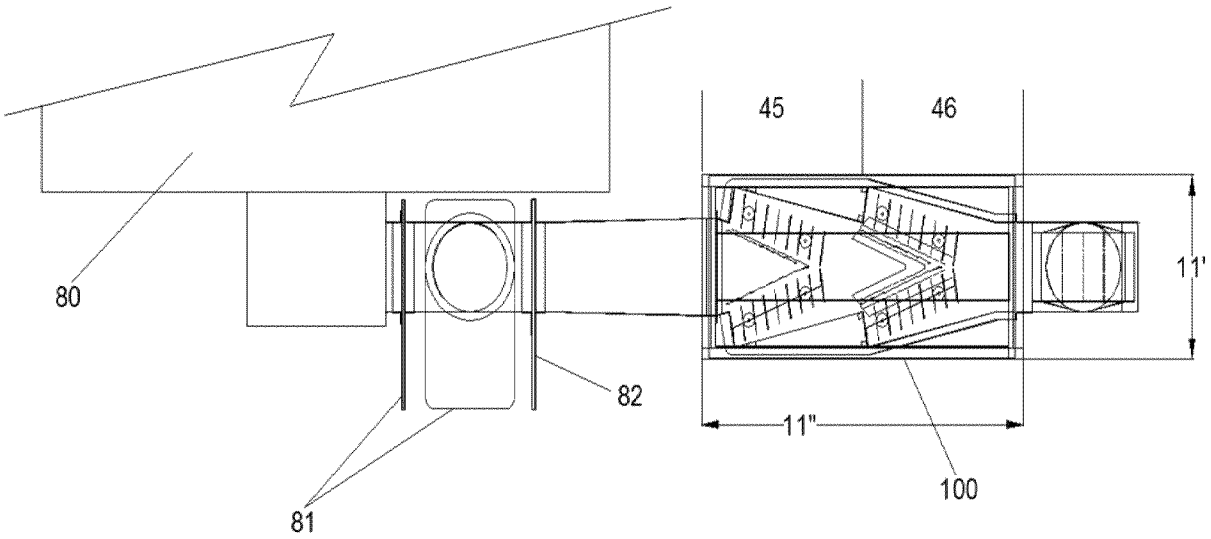
FIG. 28*a* shows a top down view of a two field vane electrostatic precipitator designed for the collection of fly ash used in home fired coal burning furnaces or stoves.
Figure 28B:
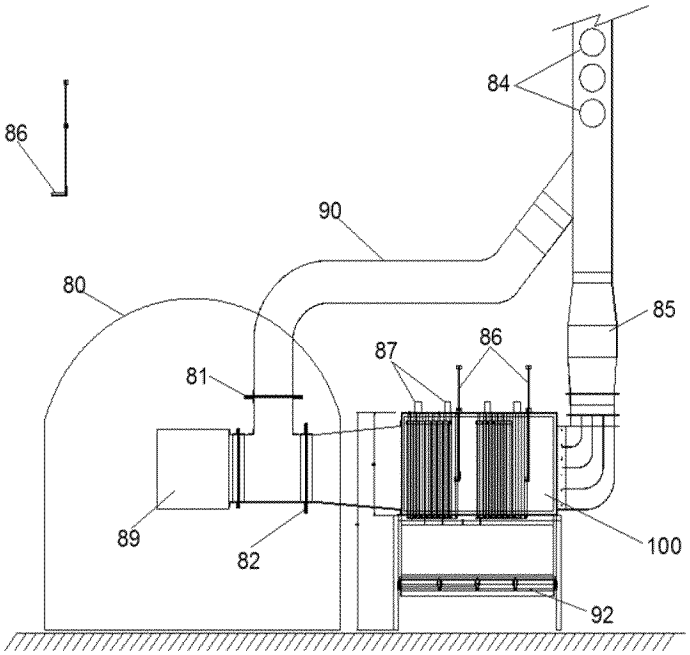
FIG. 28*b* shows a cross sectional view of FIG. 28*a*.

FIGS. 28*a* and 28*b* show a cross section view of a two field (45), (46) model of a vane electrostatic precipitator (100) that has been designed for the collection of fly ash from a home fired coal burning furnace (80). For example, the vane electrostatic precipitator of FIG. 21 could be used in this embodiment. The fly ash is collected on vanes (1) and discharged from the vanes by using either solenoid impactors (87) or scrapers (86) especially designed for this application. Other elements of the coal fire furnace system, including a slide gate (81), a perforated grate (82) (which is also shown in FIG. 21), the furnace control (84), a catalytic converter (85), the exhaust bypass (90), the ash container (92) and the furnace exit (89), are also shown. As an example, the length (11") and width (11') dimensions may be 35.50 inches and 16.50 inches, respectively.

Recent air flow tests have shown the rate of air flow can be reduced by over 90 percent even when wider spacing is used between the vanes. Tests were conducted using air flow rates between 4.63 and 6.06 m/s. The probes used for these measurements were com3 (USA1100PC), 0.15 to 1.0 m/s and com4 (UAS1200PC), 0.5-5.0 m/s.

Tests conducted on collecting fly ash at room temperature and at 6.0 m/s (input flow rate) with the VEP achieved better than 98 percent collection even with the high flow rates. Input flow rates for standard ESPs is 5 to 6 ft/sec.

Air flow control was the main focus, while collection was not, mainly because of the short resident time of particles in the VEP, about 4 to 5 tenths of a second when operating flow rates of 4.5 to 6.0 m/s were used. Vane assembly arrangements investigated to date were tapered inward approximately 2 to 6 degrees from front to back. This vane arrangement is effective in gradually removing particles and circulating the air so that all of the air entering the system is treated.

A laboratory size (6×24×18) VEP was used to study the air flow rates and air flow patterns in the area of the vanes. Various mixtures of dust were introduced to evaluate the efficiency of collection.

Figure 29:
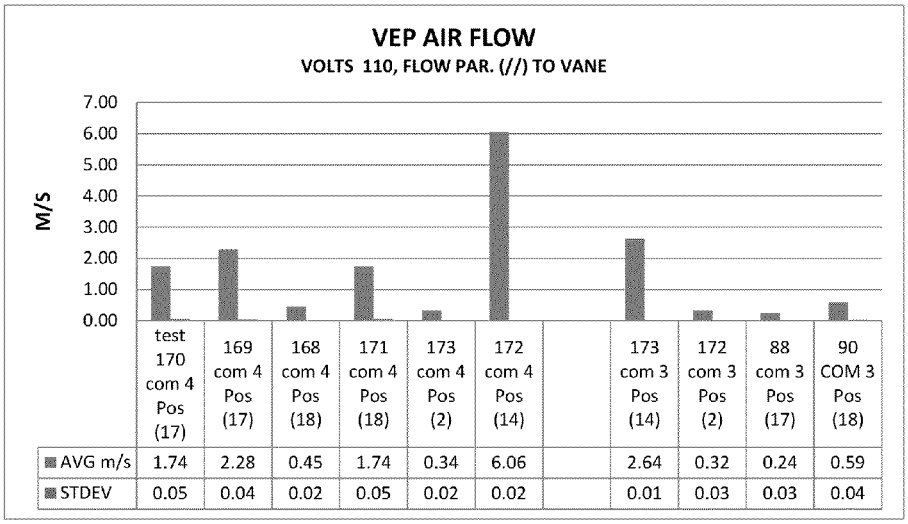
FIG. 29 shows a graph of VEP air flow rates at various positions.
Figure 30:
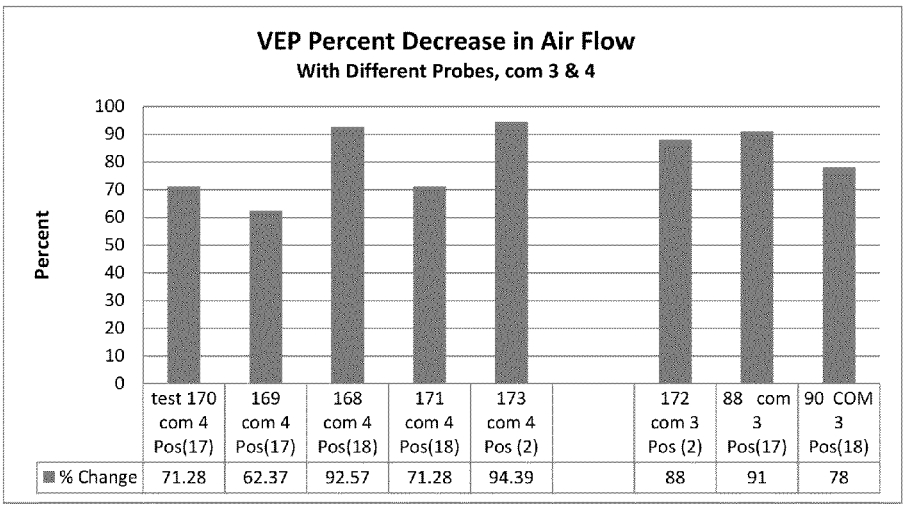
FIG. 30 shows a graph of the percent decrease in air flow in various positions relative to position 14 (the output aperture).
Figure 31:
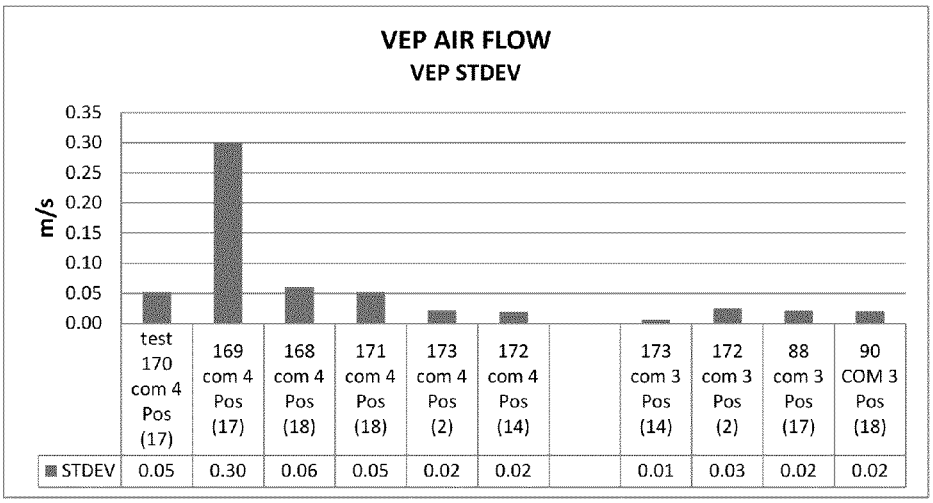
FIG. 31 shows a graph of the standard deviation from FIG. 29.
Figure 32:
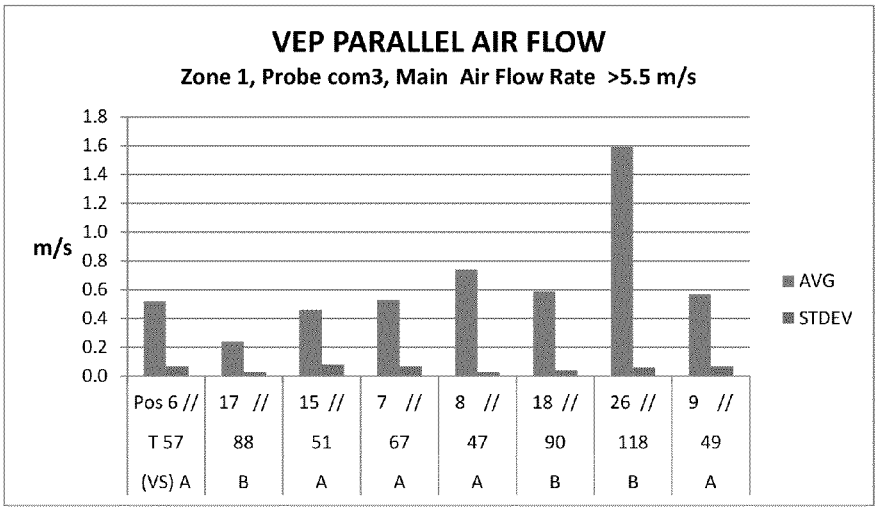
FIG. 32 shows a graph of parallel air flow at various positions.
Figure 33:
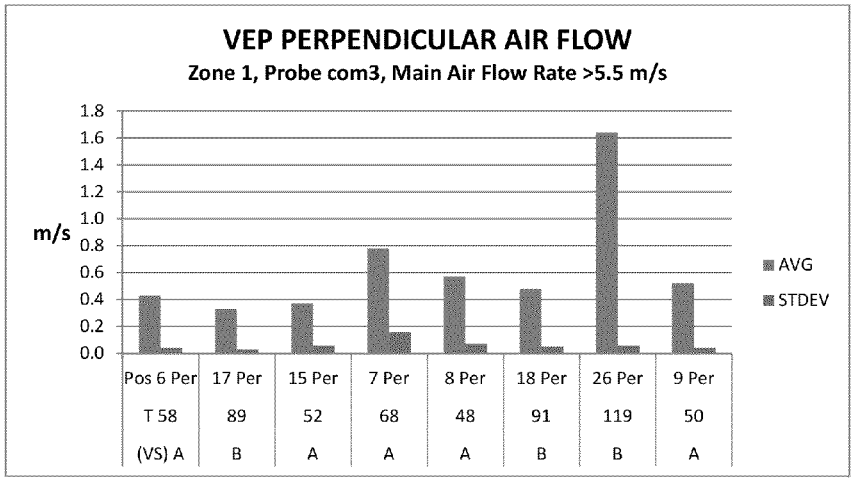
FIG. 33 shows perpendicular air flow at various positions.

FIG. 29 compares the flow rate difference between the main flow rate (sensor position [14] at exit orifice) and the air flow near the back end of the vanes, positions [2], [17] & [18]. In position [2], the air flow clearly slows down as it is pulled down out of the main air stream. FIG. 30 illustrates the percent decrease in air flow for the previous positions. The percentage change is relative to the reading at position [14] (the exit orifice). It shows the decrease in air flow compared to the reading at position [14]. FIG. 31 shows the standard deviation of FIG. 29. The STDEV is one method to determine the amount of turbulence in that location. FIGS. 32 and 33 show another method that was used to determine turbulence, where the probe was rotated 90 degrees to measure air flow parallel (FIG. 32, depicted by the parallel lines in the figure) and perpendicular (FIG. 33, Per) to the vane. VS in these figures stands for the vane style that was later changed to model identification, such as model H or Model L. The greater the difference between the two may be an indication of the amount of turbulence.

Figure 25:
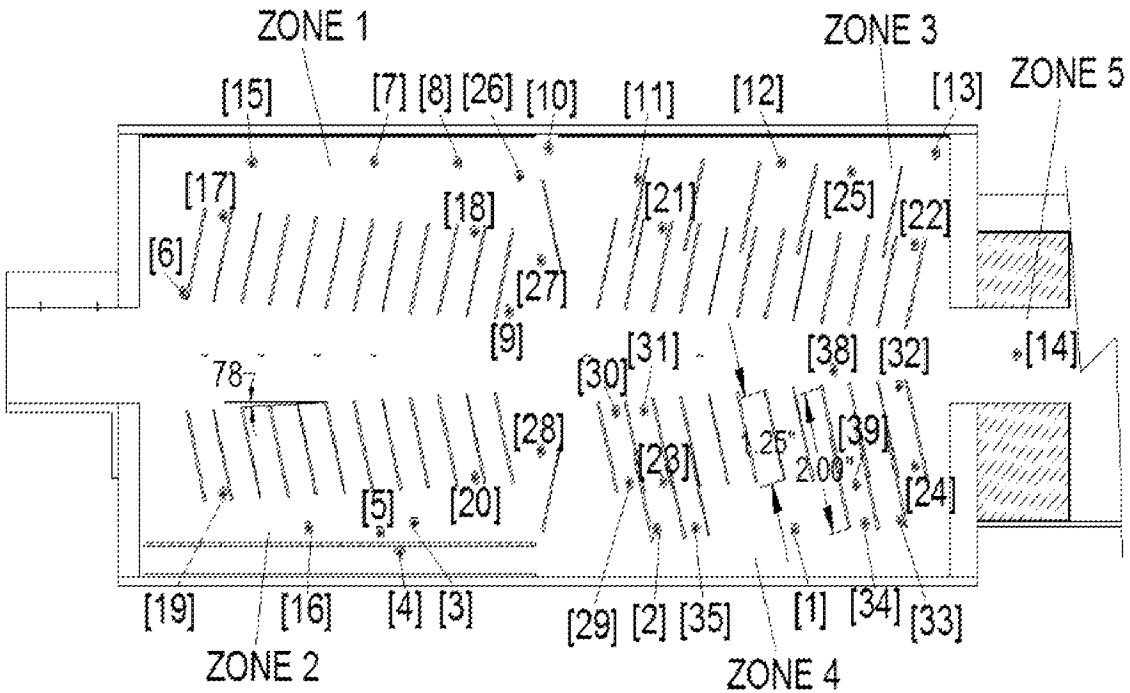
FIG. 25 shows a vane electrostatic precipitator with a model (E) vane configuration and test probe positions for this model.
Figure 26:
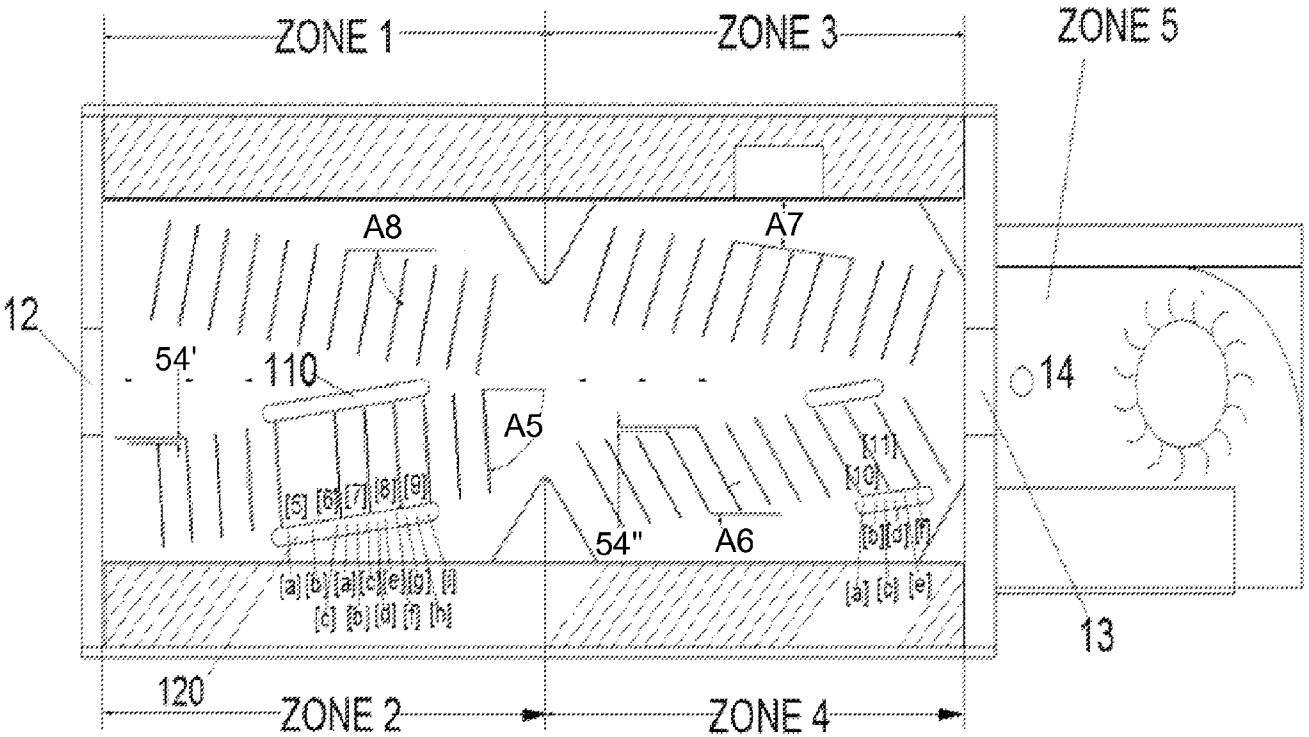
FIG. 26 shows a vane electrostatic precipitator with a model (H) vane configuration.

One of the methods to determine the required width of vanes necessary to achieve the desired flow rate of 1.0 ft/sec measures the flow rate at the input and at the exit end of the vanes. FIGS. 25 and 26 illustrate where the probe was inserted and the vane configuration used for these tests. Flow measurements were taken at the beginning and end of zone 4 with the main air flow rate measured 6.25 m/s at position [14].

During these tests, both 1.25 and 2.00 inch vane widths were investigated using twelve vanes that were 15 inches long in an assembly and approximately ½ inch apart from each other.

Two of the probes were located at the input to the vane and two in the exit end these were ([30] to [29]) and ([31] to [23]) in zone 4, shown in model VEP E, FIG. 25. The results showed a drop in air flow rate of 0.71 m/s and 0.53 m/s respectively or a 2.33 ft/sec and 1.74 ft/sec drop in air flow rate. The flow rate reduction per ⅛" or per (0.003 m) of vane length were 0.088 ft/s/0.125" or (0.027 m/s/0.003 m) and 0.066 ft/s/0.125" or (0.021 m/s/0.003 m).

Another significant factor is related to the flow rate at the input of the vanes, for position [30] (1.23 m/s), for position [31](1.68 m/s) and for position [32](4.12 m/s). These numbers reflect the effect that a 2 degree taper of the vane assembly has on deflecting and capturing the air from the main air stream. The data has resulted in a number of design changes plus the ability to design for wider apertures.

Figure 34:
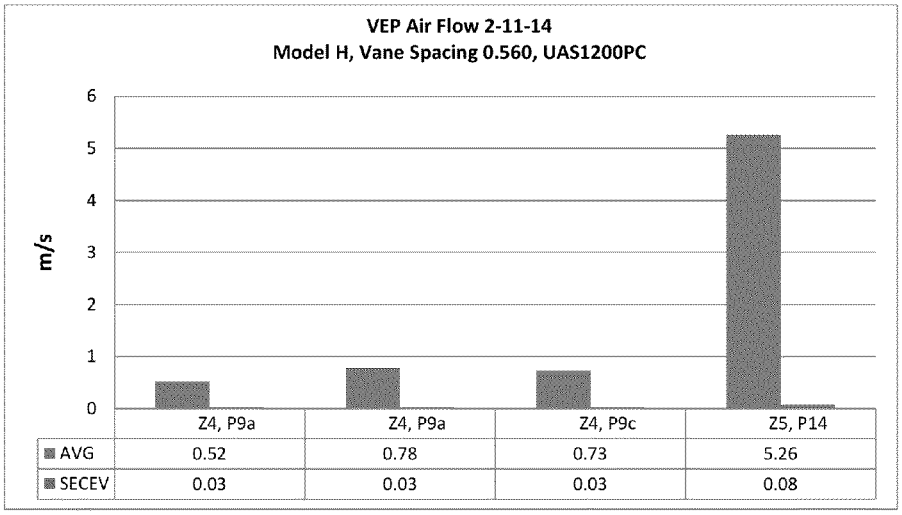
FIG. 34 shows the air flow of model H at various positions in one test, where the vane spacing was 0.560 inches.
Figure 35:
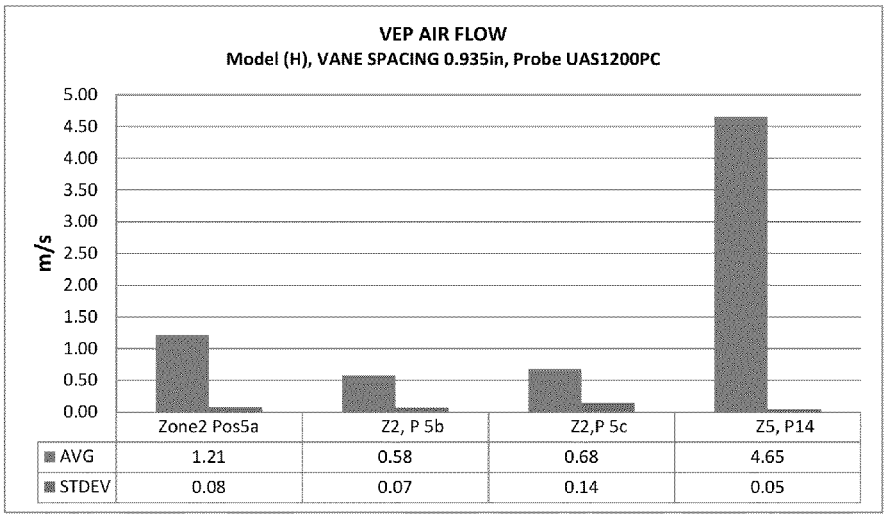
FIG. 35 shows air flow of Model H at various positions in another test, where the vane spacing was 0.935 inches.
Figure 36:
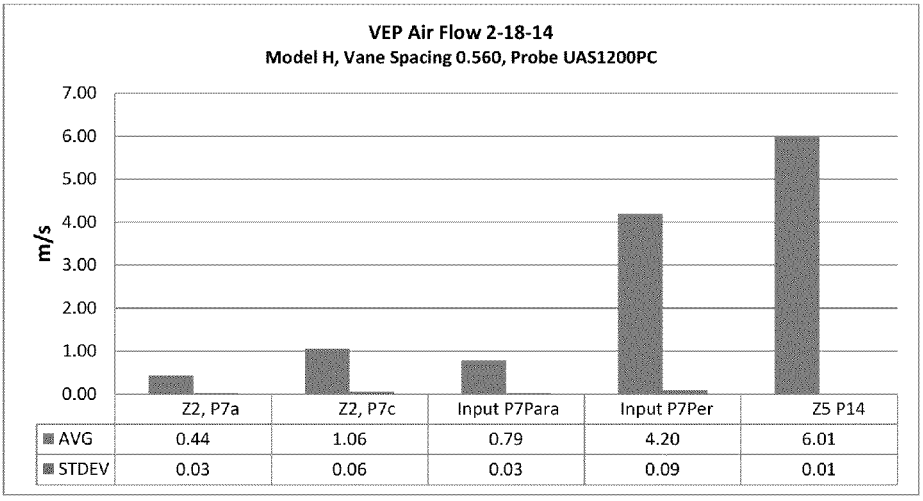
FIG. 36 shows the air flow of model H at various positions in another test, where the vane spacing was 0.560 inches.

FIGS. 34, 35, and 36 are more recent tests using the vane configuration show in FIG. 26 (model VEP-H). The vanes were accurately spaced to verify earlier results when using a 0.560 inch spacing between the vanes and to investigate the results of using a wider vane spacing of 1.0 inch.

FIG. 34 compares the difference in air flow between the airflow near the blower, position [14] and the exit end of vane positions [9] and [10] in zone 4. Two readings were taken in position [5*a*] with only a slight movement of the probe, showing how sensitive the position of the probe is. The results are favorable considering the vanes are only 1.25 inches in width.

FIG. 35 shows airflow rates taken in zone 2 and with vane 6 removed. The probe was placed in three positions between vanes 5 and 7 resulting in a vane opening close to 1.0 inch (0.935 inches). Position (a) measured air from the back side of vane 5. The average flow was 1.21 m/s. For (b) (midpoint) it was 0.58 m/s, and for (c) 0.68 m/s from the front surface of vane 7, it was 0.068 m/s. Position [14] was measured at 4.66 m/s. The slower air appears to be shifting towards vane 7.

Figure 37:
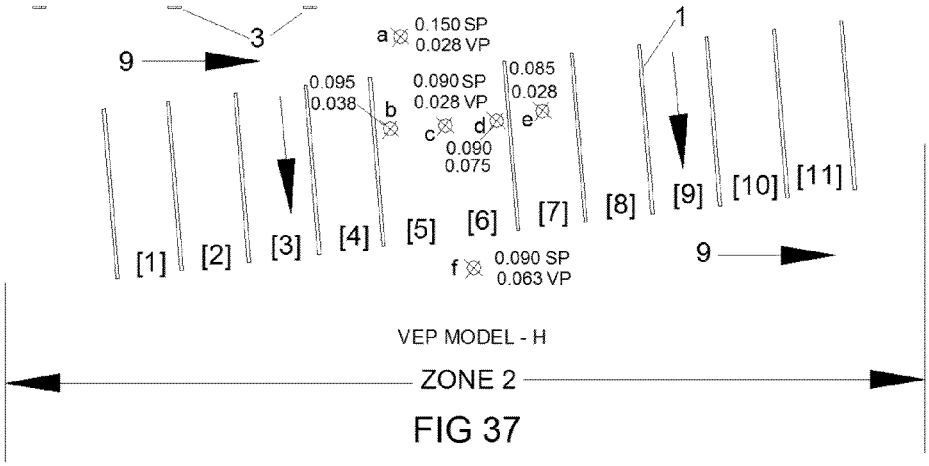
FIG. 37 shows vane positions in brackets and air pressure readings in inches of water taken in zone 2 of FIG. 26 (Model H).

Velocity and static pressure readings taken in model (H) between vanes 5 and 7 are shown in FIGS. 36 and 37. The results confirm that the air flow rate of air flowing between vanes and behind the vanes is reduced. With proper selection of the proper operating parameters, efficient collection can be achieved.

The air flow data shown in FIG. 36 of zone 2 is between vanes 6 and 7 identified as position [7]. The data shows that the airflow on the back side of vane 6 is lower than the front side of vane 7, ([7*a*]) 0.044 m/s and 1.06 m/s ([7*c*]). Two input air flow measurements were also taken. The first measurement, 0.79 m/s, was measured close and parallel to the vane air flow 7. The second reading, 4.20 m/s, was taken at position [7] by rotating the probe 90 degrees to measure the main air flow rate. The particles that are discharged from the vane surface flow away from the main air flow into an area behind the vanes, where the air flow rate is substantially reduced.

Two probes are being used to measure flow rates. Each probe has a different range: com3 (USA1100PC) 0.15 to 1.0 m/s and com4 (UAS1200PC) 0.5-5.0 m/s in. The probes are manufactured by Degree C., located in Milford, N.H. It should be noted that the probe configuration does have an effect on the reading especially when the vanes are close together. Since com3 and com4 are different probes, they influence the air flow. When comparing air flow at different locations, the comparisons are made herein between readings using the same probe.

Figure 24:
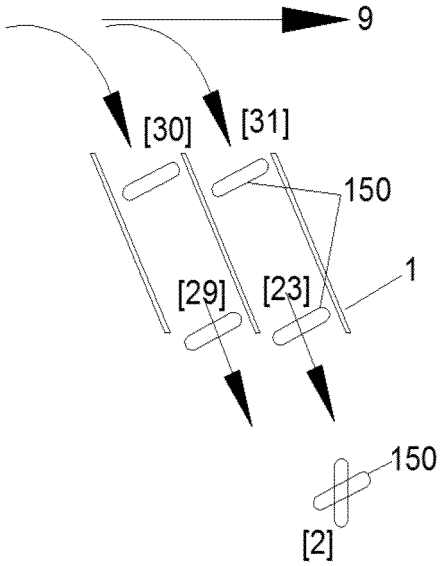
FIG. 24 shows a probe position used in the majority of the air flow rate tests.
Figure 27:
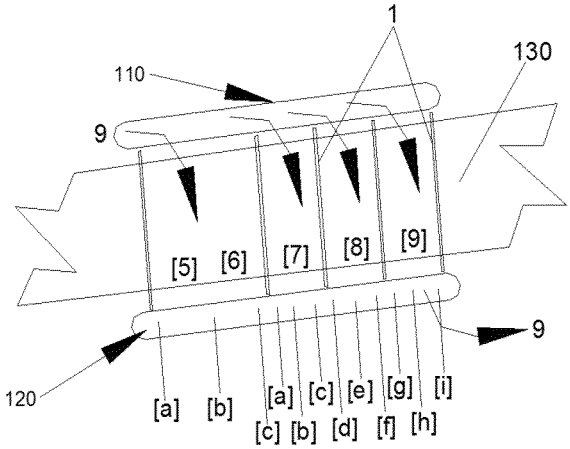
FIG. 27 represents air flow rate test probe positions for the model (H) vane configuration.

Most of the early data readings were taken at one second apart with the more recent 1, 5 or 10 seconds apart. FIG. 24 shows the location of where the probe (150) was inserted in model (E) (FIG. 25). The data taken at these readings were found close enough at the lower rate readings that either probe could be used. At the higher flow rates, com 4 was used as the actual rate. FIG. 27 shows the probe positions used to measure velocity and static air pressure readings in model (H). Both of these measurements give support to the air flow measurements.

FIG. 24 shows a probe position used in the majority of the air flow rate tests. FIGS. 25 and 26 identify two of the electrode configurations investigated to date and also shows the location of the various air flow test sights marked with a circle, vane configurations, baffles, location of mesh panels, and inner solid plates. FIG. 25 shows a vane electrostatic precipitator with a model (E) vane configuration and test probe positions for this model. Some example dimensions for the vane widths (60') and (60") are 1.25 inches and 2 inches, respectively. An example of the vane operating angle (78) is 3°.

FIG. 26 shows model (H) where the width of the VEP was reduced and all of the mesh baffles were removed. It also shows the vane assembly, individual vane operating angles and the vane offset that were used. Some examples for vane offsets (54') and (54") in this figure are 0.060 inches and 0.047 inches, respectively. Some examples of angles include 85° (A5), 53° (A6), 6° (A7) and 75° (A8).

FIG. 27 shows the air flow probe locations that were used on model (H). FIG. 27 also shows the sensor input (110) and output (120), as well as a vane support (130).

FIG. 37 shows vanes and air pressure readings from Model H (FIG. 26). The air pressure readings, which are also listed in Table 1 as static pressure (SP) and velocity pressure (VP), are in inches of water from Model (H) (FIG. 26).

TABLE 1

Air Pressure Readings in Inches of Water from Model H, Zone 2

| SENSOR LOCATION IN MODEL H | SENSOR (LOCATION OF PITOT TUBE TIP) | AIR PRESSURE READINGS |
|---|---|---|
| PARALLEL TO MAIN AIR FLOW | a | 0.150 SP<br>0.028 VP |
| AGAINST VANE 5 | b | 0.095 SP<br>0.038 VP |
| CENTERED BETWEEN VANES 5 & 7 | c | 0.090 SP<br>0.028 VP |
| AGAINST VANE 7 | d | 0.090 SP<br>0.075 VP |
| CENTERED BETWEEN VANES 7 & 8 | e | 0.085 SP<br>0.028 VP |
| PARALLEL TO MAIN AIR FLOW | f | 0.090 SP<br>0.063 VP |
| PARALLEL TO MAIN AIR FLOW AT BLOWER | g | 0.230 SP<br>0.130 VP |

In some embodiments, the vane electrostatic precipitator uses either circular wire or saw tooth (band saw blade) discharge electrodes. The saw tooth discharge electrodes can be modified by varying the number of teeth per inch or by using either straight or offset teeth along the length. Using the band saw blade or coping saw blade for smaller teeth provides for a more uniform and dependable corona discharge along the length of discharge electrode. The offset blades, where the offset is every other blade and at about 10 to 20 degrees, are used in model (L), whereas vane assemblies that are set parallel to the main air flow or set at an operating angle of zero are used in a model similar to model (I).

Figure 38:
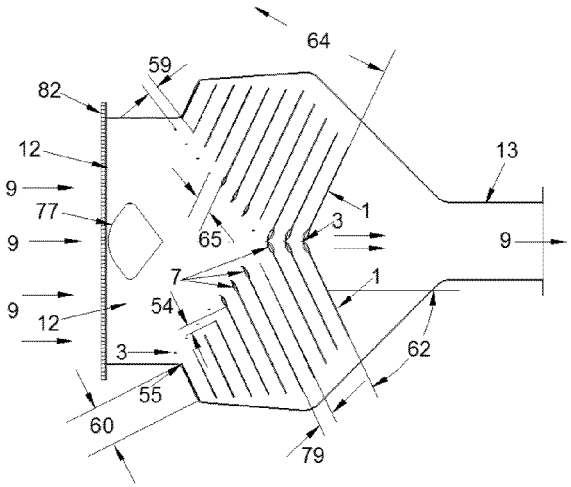
FIG. 38 shows a cross sectional view of a VEP where the vane assemblies use vanes of different lengths and the input and output apertures vary in width.

FIG. 38 shows a cross sectional view of a VEP showing the use of a perforated plate (82) located at the front aperture (12) to prevent larger particles entering the VEP. This view also shows a vane assembly with multi size vanes (60) along with the location of where the electrical field and flux lines (7) is the greatest. The view shows a one chamber concept with discharge electrodes (3) directly opposing and parallel to the vane electrodes (1). This model uses different size input (12) and output (13) apertures. By using a larger input aperture (12) than the exit aperture (13), the air input (9) is distributed over a larger area at the same time reducing the input air velocity. This factor, plus how the vane assembly (64), spacing between the vanes (79), vane offset (54), vane operating angle (62) and overall vane width (60) is set up, results in the reduction of the air flow rate and efficient collection. The difference in the input (12) and exit (13) aperture width in FIG. 38 is approximately 2 to 1.

Figure 39:
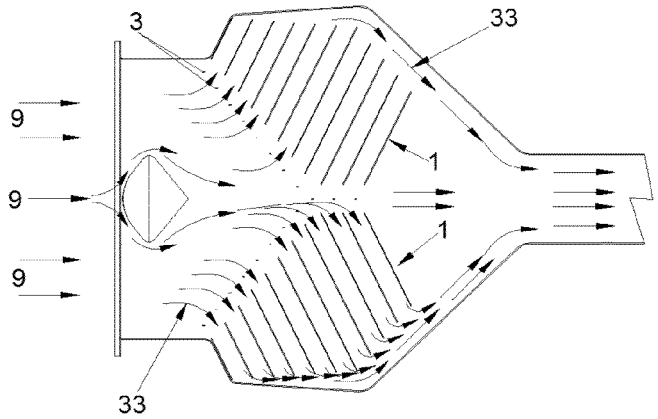
FIG. 39 shows an estimated air flow pattern for FIG. 38.
Figure 40:
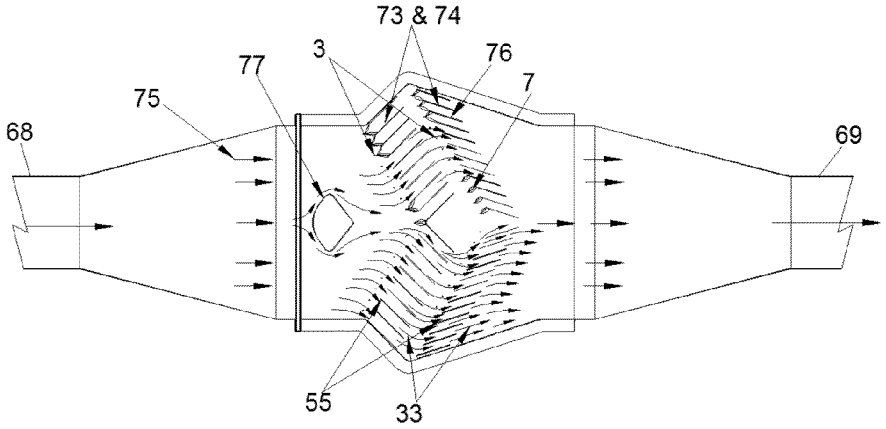
FIG. 40 shows a cross sectional view of a VEP with an estimated air flow pattern as well as vanes with similar lengths, multiple columns of vane assemblies that have alternating, and opposite vane assemblies that reverse the direction of the air flow. Vane assemblies having this arrangement are identified herein as a "single stage counter flow unit".

FIG. 39 shows an estimated air flow pattern (33) using this type of vane configuration. The use of baffles or other contoured chambers (not shown in this figure) that deflect and distribute the input air (9) can also influence the performance of the VEP FIG. 40 shows a cross sectional view of an anticipated air flow pattern (33) of the input air (75) over the vanes (1) with similar length and multiple columns of vane assembles that have alternating opposite flow (73), (74) and counter flow (76) vane assembles. This combined vane arrangement is called a single stage "counter flow unit". An advantage of using the forced reversed flow or counter flow vanes (76) is that additional stress is induced on the entrained air stream, improving collection of particulates. Also shown are the input (68) and output ducts (69) as well as the location of the electric field (7) that is generated between the saw tooth discharge electrodes (3) and the leading edge of the vane electrodes (55) plus the input air disperser (77).

Figure 41:
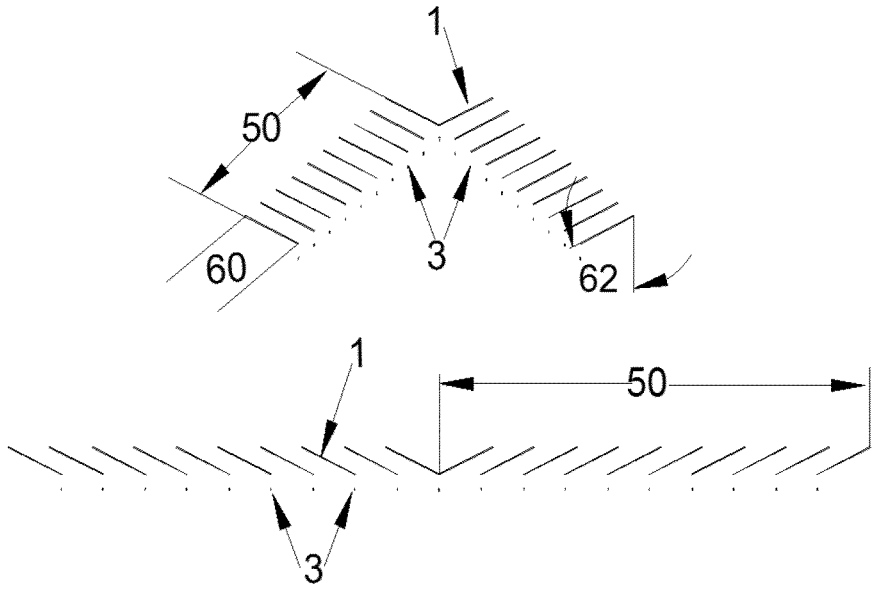
FIG. 41 shows a cross sectional view showing the advantage of using the vane assemblies on an angle as opposed to using vanes assemblies at the same operating angle but in a vertical column.

FIG. 41 shows a cross sectional view showing the effect of using the vane assembly (50) on an operating angle (62) as opposed to using vanes assemblies (50) in a vertical inline column. If the vanes (1) shown in FIG. 41 are 3.50 inches in width (60), they are equivalent to 70 inches in plate length or in parallel usage, 35.0 inches in length in a standard ESP. The vane assembly (50) shown in the preferred angular position has a depth of approximately 3.2 inches in length, an approximate eleven-to-one length advantage over the plate design.

When one considers that a standard ESP can use a distance of 12.0 inches between the discharge electrode and the plate electrode, this makes a total parallel plate distance of 24.0 inches. Comparing this width dimension with the VEP vane assembly (62) angular design of 9.70 inches, there is the potential of a substantial saving in equipment cost.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method of collecting a plurality of particles from a particle entrained air stream using a vane electrostatic precipitator, comprising the step of directing air flow in multiple directions in the vane electrostatic precipitator;

wherein the vane electrostatic precipitator comprises a first column of adjustable vane assemblies and a second column of adjustable vane assemblies;

wherein the first column of adjustable vane assemblies is parallel to the second column of adjustable vane assemblies, and wherein the first column and second column of adjustable vane assemblies have different operating angles such that the first column of adjustable vane assemblies directs air flow towards opposite walls of the vane electrostatic precipitator and the second column of adjustable vane assemblies directs air flow towards a center of the vane electrostatic precipitator;

wherein the first column of adjustable vane assemblies and the second column of adjustable vane assemblies form a single stage counter flow unit.

2. The method of claim 1, wherein the vane electrostatic precipitator further comprises an input orifice and an output orifice, wherein the input orifice and the output orifice have different sizes.

3. The method of claim 1, wherein the vane electrostatic precipitator further comprises an input orifice and an output orifice that are each at least approximately 5 to 10 feet in width and are equal in width.

4. A method for removing particles from at least one main air stream, comprising the step of dividing the main air stream into at least two smaller individual air streams in a vane electrostatic precipitator comprising a plurality of opposing rotatable vane type electrodes each having a leading edge, wherein the leading edge of each rotatable vane type electrode is offset from an adjacent leading edge.

5. The method of claim 4, further comprising the step of dimensioning an input orifice and/or an output orifice and the rotatable vane type electrodes to match operational requirements of the main air stream.

6. The method of claim 4, wherein the vane electrostatic precipitator further comprises a plurality of discharge electrodes located on an angle matching an angle of the leading edges of the rotatable vane type electrodes; the method further comprising the steps of locating the plurality of rotatable vane type electrodes at ground potential resulting in no electrical field being established between opposing vane surfaces; and establishing an electrical field between the leading edge of the rotatable vane type electrodes and the discharge electrodes.

7. The method of claim 6, wherein a distance between the leading edge of the rotatable vane type electrodes and the saw tooth discharge electrodes is between approximately ½ to 2 inches.

8. The method of claim 4, wherein the rotatable vane type electrodes in the vane electrostatic precipitator are divided into a plurality of operating groups each comprising at least two rotatable vane type electrodes, the method further comprising the step of combining the operating groups into a vane assembly to match operating requirements for the vane electrostatic precipitator.

9. The method of claim 4, wherein an offset between adjacent rotatable vane type electrodes is less than or equal to approximately 0.25 to 1.00 inches.

10. The method of claim 4, further comprising the step of adjusting a vane assembly angle during operation.

11. The method of claim 4, further comprising the step of adjusting a vane operating angle during operation.

12. The method of claim 4, wherein the vane electrostatic precipitator further comprises an input orifice and an output orifice, wherein the input orifice and the output orifice have different sizes.

13. The method of claim 4, wherein the vane electrostatic precipitator further comprises an input orifice and an output orifice that are each at least approximately 5 to 10 feet in width and are equal in width.

14. The method of claim 4, further comprising the step of collecting the particles using the vane electrostatic precipitator, wherein the rotatable vane type electrodes are located at ground potential and the vane electrostatic precipitator further comprises a plurality of discharge electrodes centrally located between the rotatable vane type electrodes, wherein the rotatable vane type electrodes are located such that there is an electrical field established between a leading edge of the rotatable vane type electrodes and the discharge electrodes and no electrical field between opposing vane surfaces.

15. The method of claim 4, wherein the vane electrostatic precipitator further comprises a plurality of discharge electrodes, the method further comprising the step of collecting the particles using an electrical field established between a leading edge of the plurality of rotatable vane type electrodes and the plurality of discharge electrodes, wherein the plurality of rotatable vane type electrodes are located at ground potential and the plurality of discharge electrodes located parallel to a main air flow direction and in proximity to the leading edge of the rotatable vane type electrodes, such that the electrical field is established between the leading edge of the rotatable vane type electrodes and the discharge electrodes and no electrical field exists between opposing surfaces of the vane type electrodes.

16. The method of claim 4, wherein the vane electrostatic precipitator further comprises a plurality of discharge electrodes, the method further comprising the step of collecting the particles using an electrical field established between a leading edge of the plurality of rotatable vane type electrodes and the plurality of discharge electrodes of the vane electrostatic precipitator, wherein the vane electrostatic precipitator comprises the plurality of rotatable vane type electrodes and the plurality of discharge electrodes in proximity to the leading edge of the rotatable vane type electrodes, and wherein a distance between the leading edge of the rotatable vane type electrodes and the discharge electrode is less than a distance between adjacent discharge electrodes.

17. The method of claim 16, wherein the distance between the leading edge of the rotatable vane type electrodes and the discharge electrodes is in the range of approximately ½ inches to 2 inches.

18. The method of claim 4, wherein the vane electrostatic precipitator further comprises a plurality of discharge electrodes, the method further comprising the step of collecting the particles using an electrical field established between a leading edge of the plurality of rotatable vane type electrodes and the plurality of discharge electrodes of the vane electrostatic precipitator, wherein the vane electrostatic precipitator comprises the plurality of rotatable vane type electrodes and the plurality of discharge electrodes in proximity to the leading edge of the rotatable vane type electrodes, wherein a ratio between a number of discharge electrodes and a number of rotatable vane type electrodes in at least one vane assembly is approximately 1:1.

19. The method of claim 4, further comprising the step of reducing an air flow rate in the vane electrostatic precipitator to at or below approximately 1.0 feet per second.

20. A method for processing large volumes of entrained air in a vane electrostatic precipitator comprising a vane assembly comprising a plurality of rotatable vane type electrodes, the method comprising the step of collecting particles from a main air flow through the precipitator, wherein the vane assembly is arranged to operate 3 to 95 degrees from the main air flow and the individual vane type electrodes operate at 45 to 95 degrees from the main air flow.

21. The vane electrostatic precipitator of claim 20, wherein the precipitator can effectively collect particles that enter the vane electrostatic precipitator with an input flow rates up to approximately 20 feet per second.

22. A method for collecting particles including highly resistant and conductive particles comprising the step of collecting particles from a main air flow in a vane electrostatic precipitator comprising a plurality of rotatable contour vanes in a vane assembly.

23. The method of claim 22, wherein the plurality of rotatable contour vanes have less than a 30 degree minor arc.

24. A vane electrostatic precipitator for collecting particles in a main air flow, comprising:

a plurality of discharge electrodes;

a plurality of rotatable vane type electrodes each having a leading edge, wherein the leading edge of each rotatable vane type electrode is offset from an adjacent leading edge such that each rotatable vane type electrode is either longer or shorter than a preceding rotatable vane type electrode; and a concentrated electric field;

wherein the discharge electrodes are centrally located between the rotatable vane type electrodes;

wherein the concentrated electric field is established between the discharge electrodes and the leading edge of the rotatable vane type electrodes where flux lines direct a plurality of charged particles to move laterally towards the rotatable vane type electrodes;

wherein no electrical field exists between opposing surfaces of the rotatable vane type electrodes; and wherein the main air flow is subdivided so that the particles are diverted and deflected by an offset between the rotatable vane type electrodes.

25. The vane electrostatic precipitator of claim 24, wherein a vane assembly operating angle of the rotatable vane type electrodes is chosen to subdivide the main air flow.

26. A method for collecting charged and uncharged particles in a vane electrostatic precipitator comprising a plurality of rotatable vane type electrodes and a plurality of discharge electrodes, comprising the step of reducing an air flow rate in the vane electrostatic precipitator to or below approximately 1.0 feet per second.

27. The method of claim 26, wherein the plurality of rotatable vane type electrodes are offset from each other, wherein an offset is created when a leading edge of each rotatable vane type electrode is offset from an adjacent leading edge such that each rotatable vane type electrode is either longer or shorter than a preceding rotatable vane type electrode.

28. The method of claim 26, wherein reducing the air flow comprises the sub step of abruptly changing a flow direction of entering entrained air with the plurality of rotatable vane type electrodes that subdivide a main air flow, wherein subdivided, diverted air is directed to flow between the rotatable vane type electrodes and drag is induced, substantially reducing a flow rate compared to a rate of the main air flow.

29. A method of collecting highly resistant and conductive particles using a vane electrostatic precipitator comprising a plurality of rotatable vane type electrodes, each rotatable vane type electrode having a vane surface, comprising the steps of:

a) processing a main air stream by directing charged and uncharged particles to flow into and between adjacent rotatable vane type electrodes at ground potential, wherein particles that flow into and between two adjacent rotatable vane type electrodes are either attracted to the surface of the vane electrode or continue to flow in a direction of lower air flow and fall by gravity towards a collection container in the vane electrostatic precipitator; and b) processing charged conductive particles by attracting the conductive particles to the surface of the rotatable vane type electrodes such that the charged conductive particles give up their charge and continue to flow in a direction of lower air flow and fall by gravity towards a collection container in the vane electrostatic precipitator.

30. A method for collecting a plurality of particles from a particle entrained main air stream using a vane electrostatic precipitator comprising a plurality of rotatable vane type electrodes and a plurality of discharge electrodes, the method comprising the step of processing the particles through the vane electrostatic precipitator, comprising at least one sub step selected from the group consisting of:

a) collecting the particles using the vane electrostatic precipitator, wherein the rotatable vane type electrodes are located at ground potential and the plurality of discharge electrodes are centrally located between the rotatable vane type electrodes such that there is an electrical field established between a leading edge of the rotatable vane type electrodes and the discharge electrodes and no electrical field between opposing vane surfaces;

b) dividing the main air stream into at least two smaller individual air streams in the vane electrostatic precipitator, wherein a leading edge of each rotatable vane type electrode is offset from an adjacent leading edge such that each rotatable vane type electrode is either longer or shorter than a preceding rotatable vane type electrode;

c) collecting the particles using the vane electrostatic precipitator, wherein an electrical field is established between a leading edge of the plurality of rotatable vane type electrodes and a plurality of saw tooth discharge electrodes, wherein the vane electrostatic precipitator comprises the plurality of rotatable vane type electrodes located at ground potential and the plurality of discharge electrodes located parallel to a main air flow direction and in proximity to the leading edge of the rotatable vane type electrodes, such that the electrical field is established between the leading edge of the rotatable vane type electrodes and the discharge electrodes and no electrical field exists between opposing surfaces of the rotatable vane type electrodes;

d) collecting the particles using an electrical field established between a leading edge of the plurality of rotatable vane type electrodes and the plurality of discharge electrodes of the vane electrostatic precipitator, wherein a distance between the leading edge of the rotatable vane type electrodes and the discharge electrode is less than a distance between adjacent discharge electrodes;

e) collecting the particles using an electrical field established between a leading edge of the plurality of rotatable vane type electrodes and the plurality of discharge electrodes of the vane electrostatic precipitator, wherein a ratio between a number of rotatable vane type electrodes and a number of discharge electrodes in at least one vane assembly is approximately 1:1; and f) collecting the particles using the vane electrostatic precipitator, wherein the vane electrostatic precipitator further comprises an input aperture and an output aperture, wherein the input aperture and the output aperture are each at least approximately 5 to 10 feet in width and are equal in width.

31. The method of claim 1, wherein a leading edge of each vane type electrode in the adjustable vane assemblies is offset from an adjacent leading edge.

32. The method of claim 4, wherein the leading edge of each rotatable vane type electrode is offset from the adjacent leading edge such that each rotatable vane type electrode in a vane assembly extends further into the main air stream than a preceding rotatable vane type electrode.

33. The method of claim 1, wherein the first column of adjustable vane assemblies is a mirror image of the second column of adjustable vane assemblies.

* * * * *